US007517627B2

(12) United States Patent
Kashiwabara et al.

(10) Patent No.: US 7,517,627 B2
(45) Date of Patent: Apr. 14, 2009

(54) TONER, IMAGE FORMING METHOD AND PROCESS-CARTRIDGE

(75) Inventors: Ryota Kashiwabara, Numazu (JP); Satoshi Matsunaga, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/304,602

(22) Filed: Dec. 16, 2005

(65) Prior Publication Data

US 2006/0134543 A1 Jun. 22, 2006

Related U.S. Application Data

(62) Division of application No. 10/212,150, filed on Aug. 6, 2002, now Pat. No. 7,026,086.

(30) Foreign Application Priority Data

Aug. 6, 2001 (JP) ..... 2001-238205

(51) Int. Cl.
*G03G 9/087* (2006.01)

(52) U.S. Cl. ..... 430/109.3; 430/109.4

(58) Field of Classification Search ..... 430/109.3, 430/109.4; 399/119

See application file for complete search history.

(56) References Cited

U.S. PATENT DOCUMENTS

| | | | | |
|---|---|---|---|---|
| 5,430,526 | A | 7/1995 | Ohkubo et al. | 399/159 |
| 5,514,511 | A | 5/1996 | Iwamoto et al. | |
| 5,908,727 | A | 6/1999 | Kawaji et al. | |
| 5,928,825 | A | 7/1999 | Eguchi et al. | 430/108.4 |
| 5,955,234 | A | 9/1999 | Matsunaga et al. | |
| 5,976,752 | A | 11/1999 | Matsunaga et al. | |
| 6,122,473 | A | 9/2000 | Goseki et al. | 399/266 |
| 6,154,625 | A | 11/2000 | Saiki et al. | 399/276 |
| 6,235,411 | B1 | 5/2001 | Blackwell et al. | 428/666 |
| 6,586,147 | B2 | 7/2003 | Iida et al. | |
| 6,593,052 | B2 * | 7/2003 | Yoshikawa et al. | 430/108.5 |
| 6,613,490 | B2 | 9/2003 | Matsunaga et al. | 430/109.3 |

FOREIGN PATENT DOCUMENTS

| | | |
|---|---|---|
| EP | 0880080 | 11/1998 |
| EP | 1205810 A2 | 5/2002 |
| JP | 05-297631 | 11/1993 |
| JP | 07-077837 | 3/1995 |
| JP | 10-087839 | 4/1998 |
| JP | 10-171156 | 6/1998 |
| JP | 11-190913 | 7/1999 |
| JP | 2000-003067 | 1/2000 |
| JP | 2000-47430 | 2/2000 |
| JP | 2000-242038 | 9/2000 |

* cited by examiner

*Primary Examiner*—Janis L Dote
(74) *Attorney, Agent, or Firm*—Fitzpatrick, Cella, Harper & Scinto

(57) ABSTRACT

A toner formed of at least a binder resin, a colorant, a charge control agent and a wax, is provided with a uniform state of dispersion of the wax and good balance of low-temperature fixability and anti-high-temperature offset characteristic, while exhibiting good developing performances over wide environmental conditions. The toner is characterized in that (a) the binder resin comprises a hybrid resin component having a polyester unit and a vinyl polymer unit, (b) the toner exhibits a loss tangent (tan δ) of 1.0 at a temperature in a range of 80-160° C., and (c) the toner provides a DSC curve showing a heat-absorption peak in a temperature range of 85-130° C. on temperature increase as measured according to differential scanning calorimetry (DSC).

1 Claim, 9 Drawing Sheets

TONER, IMAGE FORMING METHOD AND PROCESS-CARTRIDGE

CROSS-REFERENCE TO RELATED APPLICATION

This application is a division of application Ser. No. 10/212,150, filed on Aug. 6, 2002, now U.S. Pat. No. 7,026,086

BACKGROUND OF THE INVENTION

Field of the Invention

The present invention relates to a toner for use in a recording method utilizing electrophotography, electrostatic recording, electrostatic printing or toner jetting; and also an image forming method and a process-cartridge using the toner.

In electrophotographic processes in general, an electrostatic latent image is formed on a photosensitive member comprising a photoconductor material by various means and developed with a toner to form a toner image. The toner image is then transferred onto a transfer(-receiving) material such as paper, as desired, and then fixed, e.g., by heating, pressing, or heating and pressing, or with solvent vapor, to obtain a fixed toner image.

Regarding the final step of fixing the toner image onto a sheet (fixation sheet) of, e.g., paper, various methods and apparatus have been developed, and the currently most popular systems adopt a pressure-heating scheme using hot rollers or a fixed heat-generating heater via a heating film.

In the pressure-heating scheme using hot rollers, a fixation sheet carrying a toner image is caused to pass through a heating roller while the heating roller surface and the fixation sheet surface carrying the toner image are caused to contact each other, thereby fixing the toner image onto the fixation sheet. In this method, the heating roller surface and the toner image on the fixation sheet are caused to contact each other under pressure, the heat efficiency for melt-bonding the toner image onto the fixation sheet is very good, thereby allowing quick fixation.

However, as the toner image in a softened and melted state is caused to contact the heating roller surface under pressure, a portion of the toner image can be attached and transferred onto the heating or fixing roller surface and re-transferred to a subsequent fixation sheet to soil the subsequent fixation sheet. This is called an offset phenomenon. The offset phenomenon is largely affected by the fixing speed and the fixing temperature. Generally, in the case of a slow fixing speed, the heating (i.e., fixing) roller surface temperature is set to be relatively low, and in the case of a fast fixing speed, the heating roller surface temperature is set to be relatively high. This setting change is adopted in order to supply a constant amount of heat for fixation to a toner image regardless of the fixing speed.

A toner image on a fixation sheet is composed of a number of toner particle layers. As a result, in the case of a high fixing speed requiring a higher heating roller surface temperature, a large temperature difference occurs between the uppermost toner particle layer directly contacting the heating roller and the lowermost toner particle layer contacting the fixation sheet. A higher heating roller surface temperature is liable to excessively soften and melt the uppermost toner particle layer to result in an offset phenomenon. On the other hand, a lower heating roller surface temperature is liable to fail in sufficiently melting the lowermost toner particle layer for fixation and cause a fixation failure of the toner onto the fixations sheet, thus resulting in a so-called low-temperature offset phenomenon.

For solving the above-mentioned difficulties, it has been generally practiced to increase the fixing pressure in the case of a high fixing speed, thereby anchoring the toner onto the fixation sheet. By this measure, the heating roller temperature can be lowered to some extent, thereby alleviating the high-temperature offset phenomenon. In this case however, a very large shearing force is applied to the toner layer, thereby causing difficulties, such as winding offset of the fixation sheet being wound about the fixing (i.e., heating) roller, and separation claw traces (in the fixed toner image) due to action of separation claws for separating the fixation sheet from the fixing roller. Further, because of a high fixing pressure, e.g., line images are liable to be collapsed or a portion of the toner image is scattered to deteriorate the fixed toner images.

Hitherto, the improvement in toner offset phenomenon and the improvement in toner fixability have been regarded as an identical problem, but the improvement in anti-offset performance accompanying the improvement in fixability by way of improving the binder resin and wax contained in the toner has been limited in effect, and it is indispensable to improve the releasability of the toner.

Other trials of improving the releasability of a fixing member and a cleaning member constituting a fixing device may be effective for achieving a sufficient offset-preventing performance in an initial stage of use but can consequently result in offset phenomenon in a long period of use due to deterioration with time of the members if the releasability of the toner per se is insufficient.

For imparting a toner with a releasability, the toner is caused to contain a wax in some cases, but a large amount of wax has to be contained for maintaining a sufficient offset-preventing effect even by using a fixing member and a cleaning member which have been deteriorated with time. In such a case, the toner is liable to suffer from difficulties with its developing performance, such as a lowering in image density and an increase in fog density, and it becomes difficult to control the dispersion state of a wax contained in toner particles, so that the toner is liable to contain a large amount of isolated wax, which is liable to result in a strong toner attachment onto the photosensitive member and toner cleaning failure on the photosensitive member leading to image defects.

More specifically, waxes are added in the toner production stage in order to improve the toner releasability and fixability, but the uniform dispersion of waxes in toner particles is not so easy, and insufficient dispersion of wax is liable to result in problems not only in toner fixability but also in developing performance of the toner. These problems are particularly noticeable along with recent development of toners of which the particle size is becoming smaller in recent years.

JP-A 07-77837 has disclosed a toner, which comprises a binder resin that is principally composed of domain particles having sizes of 0.5-2.0 μm and a matrix, and has specified values of storage modulus (G') and loss modulus (G") measured at a frequency of 100 Hz, but the improvements in low-temperature fixability and wax dispersibility are insufficient.

JP-A 10-87839 has disclosed a binder resin obtained by forming a mixture of two mixtures of mutually different polymerization systems together with a compound reactable with boss mixtures and a release agent, and causing two polymerization reactions in a single reaction vessel, but it is difficult to construe that the low-temperature fixability and wax dispersibility have been sufficiently improved.

JP-A 10-171156 has disclosed an electrophotographic toner exhibiting a loss tangent (tan δ) of 1.0 at a temperature in a range of 55-70° C. and an elastic modulus of at most $1.5\times10^8$ Pa at that temperature, but it is impossible to say that the low-temperature fixability has been sufficiently improved.

JP-A 11-190913 has disclosed a toner, which includes a binder resin comprising a blend of a polyester and a vinyl copolymer, and has a specified temperature profile as measured by a flow tester, but it is impossible to say that the anti-high-temperature offset property and wax dispersibility are sufficient.

SUMMARY OF THE INVENTION

A generic object of the present invention is to provide a toner having solved the above-mentioned problems.

A more specific object of the present invention is to provide a toner, which comprises toner particles containing a wax uniformly dispersed therein and is excellent in low-temperature fixability and anti-high-temperature offset property.

Another object of the present invention is to provide a toner capable of exhibiting a stable image density in either a high temperature/high humidity environment or a low temperature/low humidity environment when used in either a medium- to high-speed image forming machine using a hot roller fixing device or a medium- to low-speed image forming machine using a pressure-heat fixing device including a fixed heater via a heat-resistant film.

A further object of the present invention is to provide an image forming method and a process-cartridge using a toner as mentioned above.

According to the present invention, there is provided a toner, comprising: at least a binder resin, a colorant, a charge control agent and a wax, wherein (a) the binder resin comprises a hybrid resin component having a polyester unit and a vinyl polymer unit, (b) the toner exhibits a loss tangent (tan δ) of 1.0 at a temperature in a range of 80-160° C., and (c) the toner provides a DSC curve showing a heat-absorption peak in a temperature range of 85-130° C. on temperature increase measured according to differential scanning calorimetry (DSC).

According to another aspect of the present invention, there is provided an image forming method, comprising:

(I) a developing step of developing an electrostatic image carried on an image-bearing member with the above-mentioned toner to form a toner image;

(II) a transfer step of transferring the toner image on the image-bearing member onto a recording material via or without via an intermediate transfer member; and (III) a fixing step of heat-fixing the toner image onto the recording material.

The present invention further provides a process-cartridge detachably mountable to a main assembly of an image forming apparatus for forming a toner image by developing an electrostatic latent image formed on an image-bearing member, wherein said process-cartridge includes at least (i) an image-bearing member, (ii) a vessel containing the above-mentioned toner, and (iii) a developing means for developing an electrostatic latent image carried on the image-bearing member with the toner to form a toner image on the image-bearing member, the members (i), (ii) and (iii) being integrally supported with each other.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
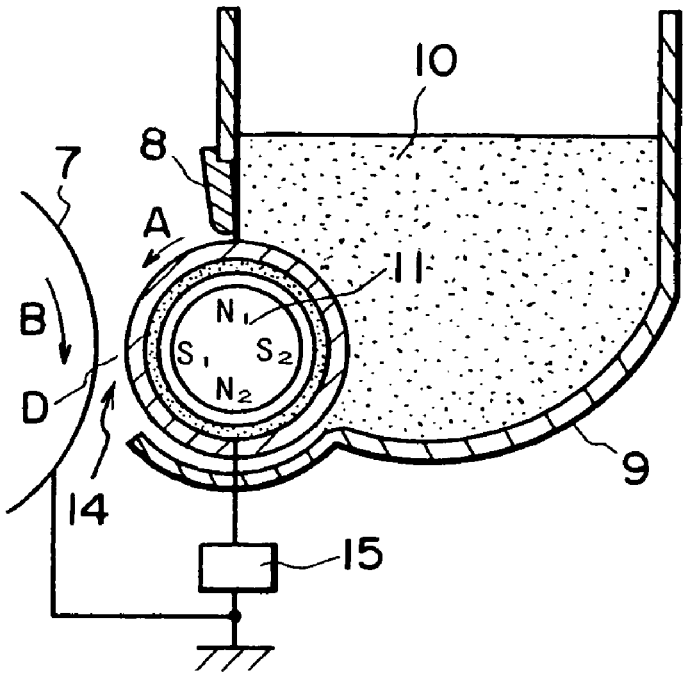
FIGS. 1 and 2 are respectively a sectional illustration of a developer replenishment-type developing device equipped with a developer-carrying member and a magnetic blade (FIG. 1) or an elastic blade (FIG. 2), respectively, as a regulating member and applicable to an embodiment of the image forming method according to the invention.

According to our study, it has been found possible to provide a toner excellent in both low-temperature fixability and anti-high-temperature offset property and capable of exhibiting stable image density even in a high temperature/high humidity environment, by using a toner binder resin comprising a hybrid resin component having a polyester unit and a vinyl polymer unit chemically bonded to each other (via an addition polymerization bond or an ester bond) and having the toner to satisfy a specific loss modulus (tan δ) characteristic and a specific DSC heat-absorption characteristic.

The toner binder resin constituting the toner of the present invention may comprise a hybrid resin composition including a hybrid resin component comprising a polyester unit and a vinyl polymer unit chemically bonded to each other and including also polyester units and vinyl polymer units not chemically bonded to each other. The hybrid resin composition may comprise the polyester units and the vinyl polymer units (bonded or non-bonded) in a weight ratio of 30:70 to 60:40, preferably 40:60 to 50:50. In either case of the polyester units occupying below 30 wt. % or above 70 wt. % of the hybrid resin composition, the combination of good low-temperature fixability and anti-high-temperature offset property is liable to be not satisfied.

In the hybrid resin composition, 10 to 50 wt. %, preferably 15 to 40 wt. %, of the polyester units and the vinyl polymer units may be chemically bonded to each other to form the hybrid resin component. If the content of the hybrid resin component is below 10 wt. % or above 50 wt. %, good combination of low-temperature fixability and anti-high-temperature offset property is liable to be failed.

The presence of a hybrid resin component may be confirmed by $^{13}$C-NMR measurement. A sample toner may be subjected to $^{13}$C-NMR as it is (in the case of a toner containing carbon black or an organic pigment) or after removing a magnetic material (which can obstruct a resolution of $^{13}$C-NMR spectrum) by immersing a magnetic toner containing such a magnetic material in a conc. hydrochloric acid aqueous solution under stirring for 70-80 hours at room temperature for dissolution of the magnetic material. Examples of $^{13}$C-NMR spectrum for a hybrid resin composition containing acrylate ester polymer units as vinyl polymer units showed several peaks as shown in the following Table 1 in parallel with the corresponding polyester and vinyl polymer.

TABLE 1

| | $^{13}$C-NMR peaks* | | | |
|---|---|---|---|---|
| | ca.168 ppm | ca.172 ppm | ca.174 ppm | ca.176 ppm |
| Polyester | — | o | o | — |
| Vinyl polymer | — | — | — | o |
| Hybrid resin | o | o | o | o |

In Table 1, "o" represents the presence, and "-" represents the absence. In the Table, the signals at ca. 172 ppm and ca. 174 ppm are attributable to carboxyl groups in an aliphatic discarboxylic acid constituting the polyester; the signal at ca. 176 ppm is attributable to the carboxyl group of the acrylate ester, and the signal at ca. 168 ppm is attributable to the hybrid resin component.

In a preferred embodiment, a hybrid resin composition constituting the binder resin of the present invention may be produced through a process wherein a saturated polyester and an unsaturated polyester are dissolved in an organic solvent, such as xylene, to form a solution, and a vinyl monomer and a polymerization initiator are added to the solution to cause radical polymerization. During the process, a hybrid resin (1) is first produced by addition polymerization between the unsaturated polyester and the vinyl monomer, and then a hybrid resin (2) is produced by (trans-)esterification between the saturated polyester and the vinyl polymer and/or a hybrid resin (3) is produced by (trans)esterification between the unsaturated polyester and the vinyl polymer.

In the toner of the present invention, the hybrid resin affects not only the fixability of the toner but also the developing performance and wax dispersibility in toner particles. From this viewpoint, it is preferred that the hybrid resin (2) formed by (trans-)esterification between the hydroxyl group of the polyester and/or the hybrid resin and the carboxyl group of the vinyl polymer is present in a larger amount than the hybrid resin (1) formed between the unsaturated polyester and the vinyl polymer. The hybrid resin (1) is present principally in a form of tetrahydrofuran (THF)-insoluble matter, whereas the hybrid resin (2) is present in forms of a THF-insoluble matter and a THF-soluble component having molecular weights of $2.9\times10^7$ to $1.0\times10^8$.

In a preferred embodiment the binder resin has a THF-soluble content substantially comprising the hybrid resin component.

In a preferred embodiment, the polyester used for producing the hybrid resin is used in a form of a mixture of a saturated polyester and an unsaturated polyester in a weight ratio of 50:1 to 1:1, preferably 30:1 to 3:1, particularly preferably 20:1 to 5:1. In the case where the ratio of the saturated polyester to the unsaturated polyester exceeds 50:1, the addition polymerization with the vinyl polymer is liable to be insufficient, thus resulting in an insufficient anti-high-temperature offset property. If the ratio is below 1:1, the low-temperature fixability of the resultant toner is liable to be remarkably impaired.

An essential feature of the toner of the present invention is that it exhibits a loss tangent (tan δ) of 1.0 at a temperature in a range of 80-160° C., preferably 90-140° C., further preferably 100-120° C. If the temperature giving a loss tangent (tan δ) of 1.0 exceeds 160° C., the anti-high-temperature offset property is liable to be insufficient, and below 80° C., the low-temperature fixability is liable to be impaired.

Another essential feature of the toner of the present invention is that it shows a thermal behavior providing a DSC curve showing a heat-absorption peak in a temperature range of 85 to 130° C. on temperature increase as measured by using a differential scanning calorimeter (DSC). The heat-absorption peak may preferably be in a temperature range of 90 to 120° C., further preferably 95 to 110 ° C. If the peak temperature is below 85° C., the storage stability and anti-high-temperature offset property of the toner are liable to be impaired. On the other hand, if the peak temperature exceeds 135° C., the low-temperature fixability of the toner is liable to be insufficient.

The THF-insoluble content of the toner may be adjusted through a control of reaction between the vinyl polymer unit and the polyester unit by end-capping the hydroxyl group of the polyester unit by reaction with an aromatic carboxylic acid, such as benzoic acid, phthalic acid or trimellitic acid. As a result, the THF-insoluble content can be controlled, thereby controlling the anti-high-temperature offset property. It is further preferred to control the THF-insoluble content by including a polyfunctional carboxylic acid having three or more carboxyl groups in the polyester unit in addition to the above-mentioned end-capping of the polyester unit, thereby easily providing a good combination of the low-temperature fixability and the anti-high-temperature offset property.

The toner of the present invention may have a ratio (Mw/Mn) between a weight-average molecular weight (Mw) and a number-average molecular weight (Mn) of 20-500, preferably 30-300, further preferably 40-100. If the ratio (Mw/Mn) is below 20, the storage stability in various environments is liable to be impaired, and above 500, the low-temperature fixability is liable to be insufficient.

The THF-soluble content of the toner may preferably exhibit such a molecular weight distribution as to contain 0.5-20%, more preferably 1-15%, further preferably 2-10% of component having molecular weights of at least $10^5$, based on its GPC chromatogram. If the content is below 0.5% or above 20%, it becomes difficult to satisfy the low-temperature fixability and the anti-high-temperature offset property in combination.

The toner of the present invention may exhibit a storage modulus (G') in a range of $1\times10^5$-$6\times10^6$, preferably $2\times10^5$-$3\times10^6$, further preferably $4\times10^5$-$10^6$, at the temperature giving loss tangent (tan δ) of 1.0. If the storage modulus (G') is below $1\times10^5$, anti-high-temperature offset property is liable to be insufficient, and above $6\times10^6$, the low-temperature fixability is liable to be impaired.

The toner of the present invention may preferably have an acid value of 5-25 mgKOH/g, more preferably 7-20 mgKOH/g, further preferably 10-17 mgKOH/g. If the acid value is below 5 mgKOH/g or above 25 mgKOH/g, it becomes difficult to obtain a toner exhibiting a stable image density in respective environments of high temperature/high humidity and low temperature/low humidity.

The THF-soluble content of the toner of the present invention may preferably contain 50-80 wt. %, more preferably 55-75 wt. %, further preferably 60-70 wt. %, of the vinyl polymer component. Below 50 wt. %, it becomes difficult to control the THF-insoluble content, thus being liable to fail in providing a sufficient anti-high-temperature offset property, and above 80 wt. %, the low-temperature fixability is liable to be impaired.

The binder resin of the toner of the present invention may contain 5-60 wt. %, preferably 10-50 wt. %, further preferably 20-40 wt. %, of THF-insoluble matter. In either case of below 5 wt. % or above 60 wt. %, it becomes difficult to satisfy the low-temperature fixability and the anti-high-temperature offset property in combination.

The wax contained in the toner of the present invention may exhibit such a molecular weight distribution according to GPC as to exhibit a peak molecular weight (Mp) of 500-20,000 and a ratio (Mw/Mn) of 1.0-20, preferably Mp=600 to 15,000 and Mw/Mn=1.1 to 15, further preferably Mp=700 to 10,000 and Mw/Mn=1. 2 to 10. If Mp is below 500, the wax dispersion particle size is liable to be excessively small, and if Mp exceeds 20,000 and the ratio (Mw/Mn) exceeds 20, the wax dispersion particle size is liable to be excessively large, so that the control of the wax dispersion particle size becomes difficult in either case. The wax has a thermal characteristic providing a DSC (differential scanning calorimetry) curve showing a heat-absorption peak in a range of 70-150° C. on temperature increase, more preferably in a range of 75-140° C., and, most preferably, in a range of 80-130° C.

The wax may preferably be contained in 0.1-20 wt. parts, more preferably 0.5-10 wt. parts, per 100 wt. parts of the binder resin.

In a preferred embodiment, such a wax, preferably a denaturated or modified wax, may be added in a step of producing a hybrid resin as a binder resin. As a result, the wax can be easily dispersed uniformly. The wax may be added either in the vinyl polymer unit production step or in the step of reaction between the polyester unit and the vinyl polymer unit.

More specifically, the wax contained in the toner of the present invention may generally comprise a hydrocarbon wax, a polyethylene or polypropylene wax, or a wax having a structure represented by formula (1) shown below, more preferably a modified wax formed by modifying a hydrocarbon wax or a polyethylene wax with a vinyl monomer and/or an aliphatic acid monomer, further preferably with an aromatic vinyl monomer. As mentioned above, such a wax may preferably be added in the binder resin production step.

Formula (1): $CH_3—(CH_2—CH_2)_a—CH_2—CH_2$-A, wherein A denotes a hydroxyl group or a carboxyl group, preferably a hydroxyl group; and a is an integer of 20-60, preferably 30-50.

Examples of the vinyl monomer and/or aliphatic acid monomer used for the wax modification may include: styrene; styrene derivatives, such as vinyltoluene; acrylic acid, and acrylate esters, such as methyl acrylate, ethyl acrylate, butyl acrylate, dodecyl acrylate, octyl acrylate, 2-ethylhexyl acrylate and phenyl acrylate; methacrylic acid, and methacrylate esters, such as methyl methacrylate, ethyl methacrylate, butyl methacrylate, dodecyl methacrylate, octyl methacrylate, 2-ethylhexyl methacrylate, and phenyl methacrylate; dicarboxylic acids having an ethylenic unsaturation and derivative thereof inclusive of maleic acid, maleic anhydride, and maleic acid half esters, such as monomethyl maleate, monoethyl maleate, monopropyl maleate, and dimethyl maleate; monomers, such as acrylamide, methacrylamide, acrylonitrile, methacrylonitrile, butadiene, vinyl chloride, vinyl acetate and vinyl benzoate; ethylenic olefins, such as ethylene, propylene and butylene; vinyl ketones, such as vinyl methyl ketone, and vinyl hexyl ketone; and vinyl ethers, such as vinyl methyl ether, vinyl ethyl ether and vinyl isobutyl ether. These modifying monomers may be used singly or in combination of two or more species. It is particularly preferred to use styrene as such a wax-modifying monomer not only for uniformizing the wax dispersion in toner particles but also for improving the flowability, storage stability and low-temperature fixability of the toner.

For providing a styrene-modified hydrocarbon wax, for example, it is preferred to add 10-100 wt. parts, more preferably 20-80 wt. parts, further preferably 30-50 wt. parts of styrene for modifying 100 wt. parts of the hydrocarbon wax.

Examples of the polymerization initiator used for modifying the wax with a monomer as described above may include: 2,2'-azobisisobutyronitrile, 2,2'-azobis(4-methoxy-2,4-dimethylvaleronitrile), 2,2'-azobis(2,4-dimethyl-valeronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2'-azobis(2-methylpropane); ketone peroxides, such as methyl ethyl ketone peroxide, acetylacetone peroxide, and cyclohexanone peroxide; 2,2-bis(t-butylperoxy)-butane, t-butylhydroperoxide, cumene hydroperoxide, 1,1,3,3-tetramethylbutyl hydroperoxide, di-tert-butyl peroxide, t-butyl cumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, diisopropyl peroxydicarbonate, di-2-ethylhexyl peroxydicarbonate, di-n-propyl peroxydicarbonate, di-2-ethoxyethyl peroxydicarbonate, di-methoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate. It is particularly preferred to use 1,1-di-(t-butylperoxy)-3,3,5-trimethylcyclohexane or dicinnamoyl peroxide. The polymerization initiators may be used singly or in mixture. When these polymerization initiators are used, the resultant vinyl polymer tends to have a branched structure, thus providing a wax with a good dispersibility regardless of the base wax species.

In the case of using a wax mixture of two or more species, at least one species thereof may preferably be modified wax as described above or a wax having a structure represented by the above-mentioned formula (1). When the wax comprises two species of waxes, it has a main peak molecular weight in a range of 500-20,000 and a ratio (Mw/Mn) of 1.2-25, more preferably it has a main peak molecular weight in a range of 700-15,000 and a ratio (Mw/Mn) of 1.5-20, and, most preferably, it has a main peak molecular weight in a range of 900-10,000 and a ratio (Mw/Mn) of 2-15. Further, at least one of the species of waxes has been added during preparation of the binder resin.

Another preferred class of wax used in the present invention may comprise a synthesized hydrocarbon obtained from distillation residue of hydrocarbons obtained from carbon monoxide and hydrogen as the starting materials through the Arge process, or hydrogenation products of such distillation residue. It is further preferred to use such a synthetic hydrocarbon after fractionation, as by press-sweating, solvent process, vacuum distillation or fractional distillation.

Some examples of a preferred combination of two wax species together with some properties of 1:1 (by weight)-mixture waxes are shown in Table 2 below:

TABLE 2

| Combination | Low-Mp wax | High-Mp wax | 1:1 (by weight) mixture |
|---|---|---|---|
| (1) | Tabs.* = ca. 80° C.<br>Mp = 500, Mw/Mn = 1.3<br>paraffin wax | Tabs. = ca. 105° C.<br>Mp = 1100, Mw/Mn = 1.7<br>styrene-modified polyethylene | Tabs. = ca. 80° C. &ca. 105° C.<br>Mp = 1100<br>Mw/Mn = 1.7 |
| (2) | Tabs. = ca. 80° C.<br>Mp = 500, Mw/Mn = 1.3<br>paraffin wax | Tabs. = ca. 105° C.<br>Mp = 1300, Mw/Mn = 1.5<br>styrene-modified polyethylene | Tabs. = ca. 105° C. |
| (3) | Tabs. = ca. 80° C.<br>Mp = 500, Mw/Mn = 1.3<br>paraffin wax | Tabs. = ca. 100° C.<br>Mp = 800, Mw/Mn = 2<br>Was of Formula (1)<br>A = OH | Tabs. = ca. 80° C. &ca. 100° C.<br>Mp = 700<br>Mw/Mn = 1.7 |
| (4) | Tabs. = ca. 80° C.<br>Mp = 500, Mw/Mn = 1.3<br>paraffin wax | Tabs. = ca. 145° C.<br>Mp = 3000, Mw/Mn = 9<br>polypropylene wax | Tabs. = ca. 80° C. &ca. 140° C.<br>Mp = 500<br>Mw/Mn = 9.3 |

*Tabs.: a heat-absorption peak temperature.

Examples of monomers for constituting the polyester unit in the hybrid resin component may include the following:

Diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenol derivatives represented by the following formula (3):

(3)

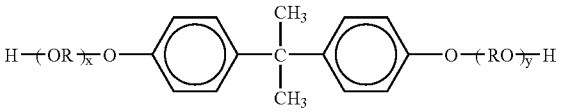

wherein R denotes an ethylene or propylene group, x and y are independently an integer of at least 1 with the proviso that the average of x+y is in the range of 2-10; diols represented by the following formula (4):

(4)

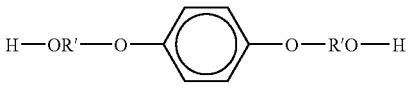

wherein R' denotes an ethylene, propylene or t-butylene group.

Examples of the acid components may include aromatic dicarboxylic acids, such as phthalic acid, isophthalic acid and terephthalic acid, and their anhydrides; alkyldicarboxylic acids, such as succinic acid, adipic acid, sebacic acid and azelaic acid, and their anhydrides; $C_6$-$C_{12}$ alkyl-substituted succinic acids, and their anhydrides; and unsaturated dicarboxylic acids, such as fumaric acid, maleic acid and citraconic acid, and their anhydrides.

In the hybrid binder resin of the present invention, the polyester unit can have a crosslinked structure formed by using a polybasic carboxylic acid having three or more carboxyl groups or its anhydride, or a polyhydric alcohol having three or more hydroxyl groups. Examples of such a polybasic carboxylic acid or anhydride thereof may include: 1,2,4-benzenetricarboxylic acid, 1,2,4-cyclohexanetricarboxylic acid, 1,2,4-naphthalenetricarboxylic acid, pyromellitic acid and anhydrides and lower alkyl esters of these acids. Examples of polyhydric alcohols may include: 1,2,3-propane triol, trimethylolpropane, hexanetriol, and pentaerythritol. It is preferred to use 1,2,4-benzenetricarboxylic acid or its anhydride.

Examples of the vinyl monomer for providing the vinyl polymer unit of the hybrid resin may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, m-nitrostyrene, o-nitrostyrene, and p-nitrostyrene; ethylenically unsaturated monoolefins, such as ethylene, propylene, butylene, and isobutylene; unsaturated polyenes, such as butadiene and isoprene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacrylonitrile, and acrylamide; esters of the below-mentioned $\alpha,\beta$-unsaturated acids and diesters of the below-mentioned dibasic acids.

Examples of carboxy group-containing monomer may include: unsaturated dibasic acids, such as maleic acid, citraconic acid, itaconic acid, alkenylsuccinic acid, fumaric acid, and mesaconic acid; unsaturated dibasic acid anhydrides, such as maleic anhydride, citraconic anhydride, itaconic anhydride, and alkenylsuccinic anhydride; unsaturated dibasic acid half esters, such as mono-methyl maleate, mono-ethyl maleate, mono-butyl maleate, mono-methyl citraconate, mono-ethyl citraconate, mono-butyl citraconate, mono-methyl itaconate, mono-methyl alkenylsuccinate, monomethyl fumarate, and mono-methyl mesaconate; unsaturated dibasic acid esters, such as dimethyl maleate and dimethyl fumarate; α,β-unsaturated acids, such as acrylic acid, methacrylic acid, crotonic acid, and cinnamic acid; α,β-unsaturated acid anhydrides, such as crotonic anhydride, and cinnamic anhydride; anhydrides between such an α,β-unsaturated acid and a lower aliphatic acid; alkenylmalonic acid, alkenylglutaric acid, alkenyladipic acid, and anhydrides and monoesters of these acids. It is preferred to use monobutyl maleate as such a carboxy group-containing vinyl monomer in view of reactivity with styrene or acrylate ester monomer to be copolymerized and easy formability of an acid anhydride at the time of distilling-off of the organic solvent, which acid anhydride promotes the formation of a hybrid resin by esterification with the hydroxyl group of the polyester.

It is also possible to use a hydroxyl group-containing monomer: inclusive of acrylic or methacrylic acid esters, such as 2-hydroxyethyl acrylate, 2-hydroxyethyl methacrylate and 2-hydroxypropyl methacrylate; 4-(1-hydroxy-1-methylbutyl)styrene, and 4-(1-hydroxy-1-methylhexyl)styrene.

In the hybrid binder resin, the polyester unit may have a crosslinked structure formed by using a polybasic carboxylic acid having three or more carboxyl group or its anhydride, or a polyhydric alcohol having three or more hydroxyl groups. Examples of such a polybasic carboxylic acid or anhydride thereof may include: 1,2,4-benzenetricarboxylic acid, 1,2,4-cyclohexanetricarboxylic acid, 1,2,4-naphthalenetricarboxylic acid, pyromellitic acid and anhydrides and lower alkyl esters of these acids. Examples of polyhydric alcohols may include: 1,2,3-propane triol, trimethylolpropane, hexanetriol, and pentaerythritol. It is preferred to use 1,2,4-benzenetricarboxylic acid or its anhydride.

In the hybrid binder resin used in the present invention, the vinyl polymer unit can include a crosslinking structure obtained by using a crosslinking agent monomer having two or more vinyl groups, examples of which may include: aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl)propanediacrylate, polyoxyethylene(4)-2,2-bis(4-hydroxyphenyl)-propanediacrylate, and compounds obtained by substituting methacrylate groups for the acrylate groups in the above compounds; and polyester-type diacrylate compounds, such as one known by a trade name of MANDA (available from Nippon Kayaku K. K.). Polyfunctional crosslinking agents, such as pentaerythritol triacrylate, trimethylolethane triacrylate, trimethylolpropane triacrylate, tetramethylohnethane tetraacrylate, oligoester acrylate, and compounds obtained by substituting methacrylate groups for the acrylate groups in the above compounds; triallyl cyanurate and triallyl trimellitate.

Such a crosslinking agent may be used in an amount of 0.01-10 wt. parts, preferably 0.03-5 wt. parts, per 100 wt. parts of the other monomers for constituting the vinyl polymer unit.

In the hybrid binder resin, it is preferred that the vinyl polymer unit and/or the polyester unit contain a monomer component reactive with these units. Examples of such a monomer component constituting the polyester unit and reactive with the vinyl polymer unit may include: unsaturated dicarboxylic acids, such as phthalic acid, maleic acid, citraconic acid and itaconic acid, and anhydrides thereof. Examples of such a monomer component constituting the vinyl polymer unit and reactive with the polyester unit may include: carboxyl group-containing or hydroxyl group-containing monomers, and (meth)acrylate esters.

In order to obtain a reaction product between the vinyl polymer unit and polyester unit, it is preferred to effect a polymerization reaction for providing one or both of the vinyl polymer unit and the polyester unit in the presence of a polymer (unit) formed from a monomer mixture including a monomer component reactive with the vinyl polymer unit and the polyester unit as described above.

Examples of polymerization initiators for providing the vinyl polymer unit according to the present invention may include: 2,2'-azobisisobutyro-nitrile, 2,2'-azobis(4-methoxy-2,4-dimethylvalero-nitrile), 2,2'-azobis(2,4-dimethyl-valeronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2'-azobis(2-methylpropane); ketone peroxides, such as methyl ethyl ketone peroxide, acetylacetone peroxide, and cyclohexanone peroxide; 2,2-bis(t-butylperoxy)-butane, t-butylhydroperoxide, cumene hydroperoxide, 1,1,3,3-tetramethylbutyl hydroperoxide, di-tert-butyl peroxide, t-butyl cumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, diisopropyl peroxydicarbonate, di-2-ethylhexyl peroxydicarbonate, di-n-propyl peroxydicarbonate, di-2-ethoxyethyl peroxydicarbonate, di-methoxyisopropyl peroxydicarbonate; di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate.

In the case of providing a magnetic toner, a magnetic material is used also functioning as a colorant. The magnetic material may comprise a magnetic oxide, such as magnetite, maghemite or ferrite, and more preferably a magnetic iron oxide containing a non-iron element or a mixture thereof.

Examples of the non-iron element may include: lithium, beryllium, boron, magnesium, aluminum, silicon, phosphorus, sulfur, germanium, tetranium, zirconium, tin, lead, zinc, calcium, barium, chromium, manganese, cobalt, copper, nickel, gallium, indium, silver, palladium, gold, platinum, tungsten, molybdenum, niobium, osmium, strontium, yttrium technetium, ruthenium, rhodium and bismuth. Preferred examples include: lithium, beryllium, boron, magnesium, aluminum, silicon, phosphorus, germanium, titanium, zirconium, tin, sulfur, calcium, barium, vanadium, chromium, manganese, cobalt, copper, nickel, strontium, bismuth and zinc. It is particularly preferred to use a magnetic iron oxide containing a non-iron element selected from magnesium, aluminum, silicon, phosphorus and zirconium. Such a non-iron element may be incorporated in the iron oxide crystal lattice, may be incorporated in the form of an oxide thereof in the iron oxide or may be present as an oxide or a hydroxide at the surface of magnetic iron oxide particles. It is preferred that the non-iron element is contained in the form of an oxide thereof.

Such a non-iron element can be incorporated in the magnetic particles by pH adjustment of an aqueous system for producing the magnetic material also containing a salt of the non-iron element. The precipitation of such a non-iron element on the magnetic particles can be effected by pH adjustment or a combination of addition of a salt of the element and pH adjustment, after formation of the magnetic particles.

A magnetic material containing such a non-iron element generally shows a good affinity with a toner binder resin, particularly with a toner binder resin having a specific acid value, and advantageously affects the dispersion of a charge control agent in a suitable state. Further, such a magnetic material can be formed in a narrow particle size distribution and is well dispersed in the binder resin, to result in a toner having improved uniformity and stability of chargeability. This is effective for providing an improvement in resistance to toner agglomeration due to non-uniform charges of toner particles of smaller particle size which is preferred in recent years, e.g., a weight-average particle size (D4) of 2.5 to 10 μm. Consequently, the toner of the present invention can be provided with remarkably improved developing performances, such as increased image density and anti-fog characteristic, even at a smaller weight-average particle size (D4) of 4.5 to 8.5 μm.

Such a non-iron element may preferably be contained in a proportion of 0.05-10 wt. %, more preferably 0.1-7 wt. %, further preferably 0.2-5 wt. %, particularly preferably 0.3-4 wt. %, based on the iron (element) in the magnetic iron oxide. Below 0.05 wt. %, the effects of the element addition become scarce, thus being liable to fail in providing good dispersibility and uniform chargeability. Above 10 wt. %, the charge liberation is increased to result in an insufficient charge which leads to lower image density and increased fog.

Such a non-iron element may preferably be dominantly present in proximity to the surface of the magnetic particles. More specifically, it is preferred that 20-100 wt. %, more preferably 25-100 wt. % of the non-iron element is dissolved at a point of 20 wt. % dissolution of the iron in the iron oxide. By the dominant presence near the magnetic particle surface of the non-iron element, it is possible to enhance the dispersion effect and the electrical diffusion effect.

The magnetic material may preferably have a number-average particle size (D1) of 0.05-1.0 μm, more preferably 0.1-0.5 μm. The magnetic material may preferably have a BET specific surface area ($S_{BET}$) of 2-40 $m^2/g$, more preferably 4-20 $m^2/g$. The magnetic material may preferably have magnetic properties including a saturation magnetization ($\sigma_s$ of 10-200 $Am^2/kg$, more preferably 70-100 $Am^2/kg$, as measured at a magnetic field of 795.8 kA/m; a residual magnetization ($\sigma_r$) of 1-100 $Am^2/kg$, more preferably 2-20 $Am^2/kg$, and a coercive force (Hc) of 1-30 kA/m, more preferably 2-15 kA/m. The magnetic material may be added in an amount of 20-200 wt. parts per 100 wt. parts of the binder resin.

The contents of elements in the magnetic material may be measured by fluorescent X-ray analysis according to JIS K0119 (fluorescent X-ray analysis: general rules) by using a fluorescent X-ray analyzer (e.g., "SYSTEM 3080", made by Rigaku Denki Kogyo K. K.). The elementary distribution may be determined by gradual dissolution of a magnetic material with hydrochloric acid or hydrofluoric acid, and measuring the change in element content in the solution by ICP (inductively coupled plasma) emission spectroscopy.

The number-basis particle size distribution of a magnetic material may be measured by processing enlarged photographs taken through a transmission electron microscope by means of a digitizer, etc. The magnetic properties are based on values measured by using a sample vibration-type magnetometer ("VSM-3S-15", made by Toei Kogyo K. K.) and applying an external magnetic field of 795.8 kA/m. The specific surface areas described herein are based on values measured according to the BET multi-point method using nitrogen as the adsorbate gas and by using a specific surface area measurement apparatus ("Autosorb 1", made by Yuasa Ionics K. K.).

In the case of providing a non-magnetic toner, arbitrary pigments or dyes may be added. Examples of the pigment may include: carbon black, aniline black, acetylene black, Naphthol Yellow, Hansa Yellow, Rohdamine Yellow, Alizarin Yellow, red iron oxide, and Phthalocyanine Blue. The pigment may be used in an amount for providing a sufficient optical density, e.g., 0.1-20 wt. parts, preferably 0.2-10 wt. parts, per 100 wt. parts of the binder resin. For a similar purpose, a dye can be used. Examples thereof may include: azo dyes, anthraquinone dyes, xanthene dyes and methine dyes. The dye may be used in 0.1-20 wt. parts, preferably 0.3-10 wt. parts, per 100 wt. parts of the binder resin.

The toner of the present invention may preferably contain a charge control agent, which may be basically any of known ones. In the present invention, however, it is particularly preferred to use an organic iron compound formed of iron and a monoazo compound of formula (4) below:

(4)

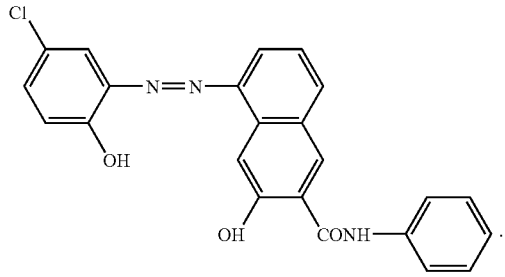

The toner of the present invention may contain external additives selected from inorganic oxides, such as silica, alumina and titania, and other materials, such as carbon black and fluorinated carbon, in the form of fine particles, e.g., having a number-average particle size (D1) of 5-100 nm, more preferably 5-50 nm, so as to exhibit a good flowability-imparting effect when attached to toner particle surfaces.

More specifically, a particularly preferred class of external additive is a flowability-improving agent. Examples thereof may include: fine powders of fluorine-containing resins, such as polyvinylidene fluoride and polytetrafluoroethylene; fine powders of inorganic oxides such as wet-process silica, dry-process silica, titanium oxide and alumina, and surface-treated products of these inorganic oxide fine powders treated with silane compounds, titanate coupling agent and silicone oil.

It is preferred to use a so-called dry-process silica or fumed silica, which is fine powdery silica formed by vapor-phase oxidation of a silicone halide, e.g., silicon tetrachloride. The basic reaction may be represented by the following scheme:

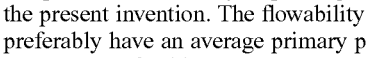

$$SiCl_4+2H_2+O_2 \rightarrow SiO_2+4HCl.$$

In the reaction step, another metal halide, such as aluminum chloride or titanium, can be used together with the silicon halide to provide complex fine powder of silica and another metal oxide, which can be also used as a type of silica as a preferred flowability-improving to be used in the toner of the present invention. The flowability-improving agent may preferably have an average primary particle size of 0.001-2 μm, more preferably 0.002-0.2 μm.

Examples of commercially available silica fine powder products formed by vapor-phase oxidation of silicon halides may include those available under the following trade names: AEROSIL 130, 200, 300, 38, TT600, MOX170, MOX80 and COK84 (available from Nippon Aerosil K. K.); Ca—O—SiL M5, MS-7, MS-75, HS-5 and EH-5 (Cabot Co.); HDK N20, 15, N20E, T30 and T40 (Wacker-Chemie GMBH), D-C FINE SILICA (Dow Corning Co.); and FRANSOL (Fransil Co.).

It is further preferred to use such silica fine powder after a hydrophobization treatment, so as to provide a hydrophobicity in a range of 30-80 as measured by the methanol wettability titration test.

The hydrophobization may be effected by treating the silica fine powder with an organosilicon compound reactive with or physically adsorbed by the silica fine powder.

Examples of the organosilicon compound may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylsiloxanes having 2-12 siloxane units per molecule including terminal units each having one hydroxyl group connected to Si; and further silicone oils, such as dimethylsilicone oil. These organosilicon compounds may be used singly, or in mixture, or in succession of two or more species.

The flowability-improving agent may preferably have a specific surface area as measured by the BET method using nitrogen adsorption ($S_{BET}$) of at least 30 $m^2/g$, more preferably at least 50 $m^2/g$. The flowability-improving agent may preferably be used in a proportion of 0.01-8 wt. parts, more preferably 0.1-4 wt. parts, per 100 wt. parts of the toner.

The toner of the present invention can contain various additives, in addition to the flowability-improving agent, for imparting various properties. Examples of such additives may include the following.

(1) Abrasives, inclusive of: metal oxides, such as strontium titanate, cerium oxide, aluminum oxide, magnesium oxide and chromium oxide; nitrides, such as silicon nitride; carbides, such as silicon carbide; metal salts, such as calcium sulfate, barium sulfate and calcium carbonate.

(2) Lubricants, inclusive of: powders of fluorine-containing resins, such as polyvinylidene fluoride and polytetrafluoroethylene; and fatty acid metal salts, such as zinc stearate and calcium stearate.

(3) Charge-controlling particles, inclusive of: particles of metal oxides, such as tin oxide, titanium oxide, zinc oxide, silicon oxide, and aluminum oxide; carbon black, and resin particles.

These additives may be added in an amount of 0.05-10 wt. parts, preferably 0.1-5 wt. parts, per 100 wt. parts of the toner particles. These additives may be used singly or in combination of two or more species.

In the case of providing a magnetic toner, it is preferred to add two or more species of additives in combination in view of the stability of continuous developing performance and the stability of developing performance after standing. In the case of providing a non-magnetic monocomponent developer, it is preferred to use titanium oxide or alumina in view of the improved flowability and image uniformity.

The toner of the present invention can also be blended with a carrier to provide a two-component developer. The carrier may preferably have a resistivity of $10^6$-$10^{10}$ ohm·cm adjusted, e.g., by controlling the surface unevenness of carrier particles and the amount of a surface-coating resin.

Example of the surface-coating resin may include: styrene-acrylate copolymers, styrene-methacrylate copolymers, acrylate ester copolymers, methacrylate ester copolymers, silicone resin, fluorine-containing resin, polyamide resin, ionomer resin, polyphenylene sulfide resin, and mixture of these resins.

The carrier core may comprise a magnetic material, examples of which may include: oxides, such as ferrite, iron-excessive ferrite, magnetite and gamma-iron oxide; metals, such as iron, cobalt and nickel, and alloys of these metals. These magnetic materials can further contain other elements, such as iron, cobalt, nickel, aluminum, copper, lead, magnesium, tin, zinc, antimony, beryllium, bismuth, calcium, manganese, selenium, titanate, tungsten, and vanadium.

Hereinbelow, some preferred embodiments of the image forming method according to the present invention using the toner of the present invention will be described with reference to drawings.

First, a developing means (apparatus) applicable to the image forming method of the present invention will be explained.

Referring to FIG. 1, an electrophotographic photosensitive drum 7 (as an example of an image-bearing member for bearing an electrostatic latent image formed by a known process) is rotated in a direction of arrow B. On the other hand, a developing sleeve 14 (as a developer-carrying member) carrying a toner 10 (as a mono-component developer) supplied from a hopper 9 is rotated in a direction of arrow A to convey a layer of the toner 10 to a developing region D where the developing sleeve 14 and the photosensitive drum 7 oppose each other. In the case where the toner 10 is a magnetic toner, a magnet 11 is disposed within the developing sleeve so as to magnetically attract and hold the magnetic toner 10 on the developing sleeve, whereby the toner is subjected to friction with the developing sleeve 14 to acquire a triboelectric charge sufficient for developing an electrostatic latent image on the photosensitive drum 7.

In order to regulate the layer thickness of the magnetic toner 10, a regulating magnetic blade 8 comprising a ferromagnetic metal is hung down from the hopper 9 to confront the developing sleeve 14 with a gap of ca. 200-300 μm from the surface of the developing sleeve 14. Lines of magnetic induction from a magnetic pole $N_1$ of the magnet 11 are concentrated to the blade 8, whereby a thin layer of the toner 10 is formed on the developing sleeve 14. The blade 8 can also comprise a non-magnetic blade. Further, in the case where the toner 10 is a non-magnetic toner, the blade 8 may be an elastic blade comprising urethane rubber, silicone rubber, tip blade, etc.

The thin layer thickness of the toner 10 formed on the developing sleeve 14 may preferably be smaller than the minimum gap between the developing sleeve 14 and the photosensitive drum 7 at the developing region D. The image forming method according to the present invention is particularly effective in such a developing apparatus for the scheme wherein an electrostatic latent image is developed with such a thin layer of toner, i.e., a non-contact type developing apparatus. However, the image forming method according to the present invention is also applicable to a developing apparatus wherein the toner layer thickness is larger than the minimum gap between the developing sleeve 14 and the photosensitive drum 7 at the developing region, i.e., a contact-type developing apparatus.

Hereinbelow, further description of a non-contact type developing apparatus will be made.

Referring again to FIG. 1, the developing sleeve 14 is supplied with a developing bias voltage from a power supply 15 so as to cause a jumping of a toner 10 (as a mono-component developer) carried on the developing sleeve 14. In the case where the developing bias voltage is a DC voltage, it is preferred that the developing sleeve 14 is supplied with a developing bias voltage which is equal to a voltage given as a difference between a potential of an image region (where the toner 10 is attached to provide a visual image region) and a potential of a background region of an electrostatic latent image. On the other hand, in order to increase the density or gradational characteristic of a developed image, it is also possible to apply an alternating bias voltage to the developing sleeve 14, thereby forming a vibrating field of which the voltage polarity alternates with time at the developing region D. In this case, it is preferred that the developing sleeve 14 is supplied with an alternating bias voltage superposed with a DC voltage component equal to the above-mentioned difference between the image region potential and the background region potential.

Further, in the case of a so-called normal development scheme wherein a toner is attached to a higher potential region of an electrostatic latent image having such a higher-potential region and a lower-potential region, a toner charged to a polarity opposite to that of the electrostatic latent image is used. On the other hand, in the case of the reversal development scheme wherein a toner is attached to a lower-potential region of an electrostatic latent image, a toner charged to a polarity identical to that of the electrostatic latent image is used. Herein, a higher-potential and a lower-potential refers to potential in terms of absolute value. In any case, the toner 10 is triboelectrically charged due to friction between the toner 10 and the developing sleeve 14 to a polarity appropriate for developing an electrostatic latent image on the photosensitive drum 7.

Figure 2:
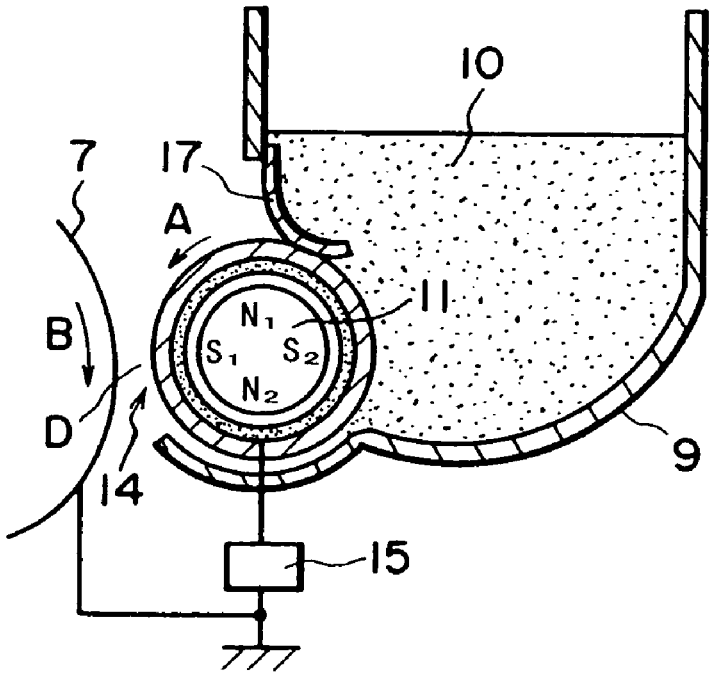

In a developing apparatus shown in FIG. 2, an elastic plate 17 comprising a material having a rubber elasticity, such as urethane rubber or silicone rubber, or a material having a metal elasticity, such as phosphor bronze or stainless steel, is used as a member for regulating the layer thickness of toner 10 on a developing sleeve 14, and the elastic plate 17 is pressed against the developing sleeve 14. In such a developing apparatus, a further thin toner layer can be formed on the developing sleeve 14. The other structure of the developing apparatus shown in FIG. 2 is basically identical to that of the apparatus shown in FIG. 1, and identical numerals in FIG. 2 represent identical members as in FIG. 1.

In the developing apparatus of FIG. 2, the toner is applied by rubbing with the elastic plate 17 onto the developing sleeve 14 to form a toner layer thereon, so that the toner can be provided with a larger triboelectric charge and thus results in a higher image density. This type of developing apparatus is used for a non-magnetic mono-component toner.

Figure 3:
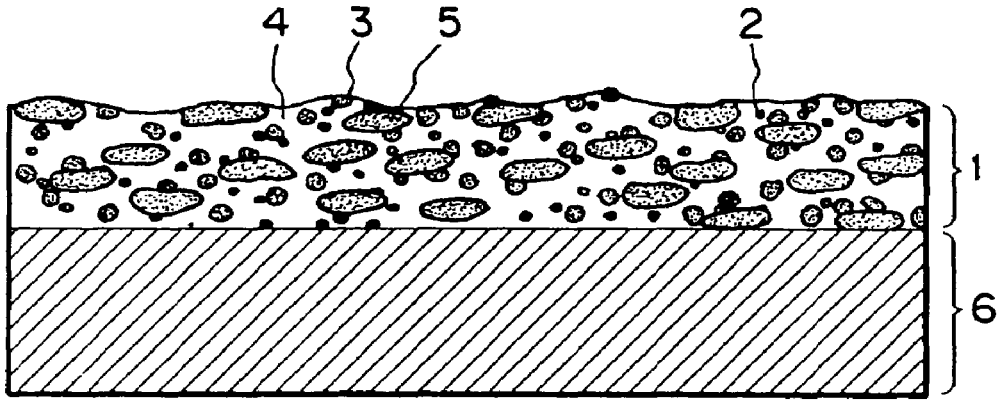
FIG. 3 is a partial sectional illustration of a developer-carrying member applicable to an embodiment of the image forming method according to the invention.

The developing sleeve used as a developer-carrying member in the present invention may preferably comprise a cylindrical substrate and a resinous coating layer coating the substrate surface. An example of such a structure is illustrated in FIG. 3 which is a partial sectional view of the sleeve. Referring to FIG. 3, a cylindrical substrate 6 is coated with a resinous coating layer 1 which may comprise a binder resin 4 and optionally an electroconductive substance 2, a filler 3, a solid lubricant 5, etc., as desired. In the case where the electroconductive substance 2 is contained, the resin coating layer 1 becomes electroconductive. This is effective for preventing excessive charge of the toner. In the case where the filler 3 is contained, the wearing of the resin coating layer 1 may be suppressed, and the toner charge can be suitably controlled by the charge-imparting ability of the filler 3. Further, in the case where the solid lubricant 5 is contained, the releasability between the toner and the developing sleeve can be improved, thereby preventing melt-sticking of the toner onto the developing sleeve.

In the case of incorporating an electroconductive substance in a resinous coating layer, the resinous coating layer may preferably exhibit a volume resistivity of at most $10^6$ ohm·cm, more preferably at most $10^3$ ohm·cm. In the case where the volume resistivity of the resinous coating layer exceeds $10^6$ ohm·cm, the toner is liable to be excessively charged, thus resulting in occurrence of blotches or inferior developing performance.

The resinous coating layer may preferably have a surface roughness Ra in the range of 0.2-3.5 μm in terms of JIS center-line-average roughness. If Ra is below 0.2 μm, the toner charge in proximity to the sleeve is liable to be excessive, so that the toner is rather firmly held by the sleeve due to an image force and accordingly a fresh toner portion cannot be charged by the sleeve, thereby lowering the developing performance. If Ra exceeds 3.5 μm, the toner coating amount on the sleeve is liable to be excessive, so that the toner cannot be sufficiently charged but is ununiformly charged, thereby causing a lowering and irregularity of image density.

The resinous coating layer 1 may comprise materials as follows.

Referring to FIG. 3, examples of the electroconductive substance 2 may include: powder of metals, such as aluminum, copper, nickel and silver; powder of metal oxides, such as antimony oxide, indium oxide and tin oxide; and carbon homologues, such as carbon fiber, carbon black and graphite powder. Among these, carbon black is particularly excellent in electroconductivity and is suitably used because it imparts an electroconductivity when incorporated in a polymeric material at a fairly arbitrarily controlled level by controlling the addition amount thereof. The carbon black may preferably have a number-average particle size of 0.001-1.0 μm, more preferably 0.01-0.8 μm. In excess of 1 μm, it becomes difficult to control the volume resistivity of the resinous coating layer.

The electroconductive substance 2 may preferably be added in 0.1-300 wt. parts, more preferably 1-100 wt. parts, per 100 wt. parts of the binder resin 4 constituting the resinous coating layer 1.

The filler 3 may comprise a negative or positive charge control agent for toners. Examples of other materials constituting the filler 3 may include: inorganic compounds, such as aluminum, asbestos, glass fiber, calcium carbonate, magnesium carbonate, barium carbonate, barium sulfate, silica and calcium silicate; phenolic resin, epoxy resin, melamine resin, silicone resin, polymethyl methacrylate, methacrylate copolymers such as styrene/n-butylmethacrylate/silane terpolymer, styrene-butadiene copolymer, polycaprolactone; nitrogen-containing compounds, such as polycaprolactam, polyvinylpyridine, and polyamide; halogen-containing polymer, such as polyvinylidene fluoride, polyvinyl chloride, polytetrafluoroethylene, polychlorotrifluoroethylene, perfluoroalkoxyl-trifluoroethylene, polytetrafluoroalkoxyethylene, hexafluoropropylene-tetrafluoroethylene copolymer, and trifluorochloroethylene-vinyl chloride copolymer; polycarbonate, and polyester. Among these, silica and alumina are preferred because of their hardness and toner chargeability controlling effect.

Such fillers 3 may preferably be used in 0.1-500 wt. parts, more preferably 1-200 wt. parts, per 100 wt. parts of the binder resin 4.

The solid lubricant 5 may comprise, e.g., molybdenum disulfide, boron nitride, graphite, fluorinated graphite, silver-niobium selenide, calcium chloride-graphite, or talc. Among these, graphite may preferably be used because it has electroconductivity in addition to lubricity and may exhibit a function of reducing a portion of toner having an excessive charge to provide a level of charge suitable for development.

The solid lubricant 5 may preferably be added in 0.1-300 wt. parts, more preferably 1-150 wt. parts, per 100 wt. parts of the binder resin 4.

The binder resin 4 used for constituting the resinous coating layer 1 optionally together with such electroconductive substance 2, filler 3 or/and solid lubricant 5, added as desired, may comprise a resin, such as phenolic resin, epoxy resin, polyamide resin, polyester resin, polycarbonate resin, polyolefin resin, silicone resin, fluorine-containing resin, styrene resin or acrylic resin. It is particularly preferred to use a thermosetting or photocurable resin.

The developing sleeve may be provided with further preferable performances by surface treatment thereof as by abrasion or polishing for surface smoothing so as to expose the electroconductive substance 2, filler 3 or/and solid lubricant 5 to the sleeve surface at an appropriate level, or/and to smooth the surface for providing a surface with a uniform unevenness. This is particularly effective for suppressing longitudinal streaks appearing in solid black or halftone images or quickly providing a sufficient image density at the startup of image formation, particularly in a high temperature/high humidity environment. The abrasion or polishing treatment may be performed by using an abrasion or polishing stripe of felt or abrasive particle-attached strip for finishing the sleeve surface to a uniform unevenness, whereby the toner coating amount on the sleeve can be uniformized, thereby allowing only toner particles subjected to triboelectrification with the sleeve to be conveyed to the developing region. This is assumed to be the mechanism for the improved performances.

After the surface-smoothing treatment, the coating layer may preferably retain a surface roughness Ra (according to JIS B0601) in the range of 0.2-3.5 μm, more preferably 0.3-2.5 μm, for the same reason as described above.

The cylindrical substrate 6 may preferably comprise a cylinder of a non-magnetic metal or a resin. For example, the substrate can be a non-magnetic cylindrical tube, such as that of stainless steel, aluminum or copper. Such a cylindrical tube may be produced through drawing or extrusion, preferably followed by cutting or polishing for improving the size accuracy to a prescribed size accuracy. The cylindrical tube may preferably have a straight allowance of at most 30 μm, more preferably at most 20 μm, thus providing good images. The tube may be subjected to sand blasting or abrasion to provide a rough surface with an appropriate degree of surface unevenness. The blasting may be performed by using abrasive particles which may be definitely shaped or indefinitely shaped.

Now, an example of the image forming method according to the present invention, will be described with reference to FIG. 4, which illustrates an image forming apparatus including a contact charging means and a contact transfer means. In the present invention, it is possible to employ an image forming method including a corona charging scheme or/and a corona transfer scheme.

Figure 4:
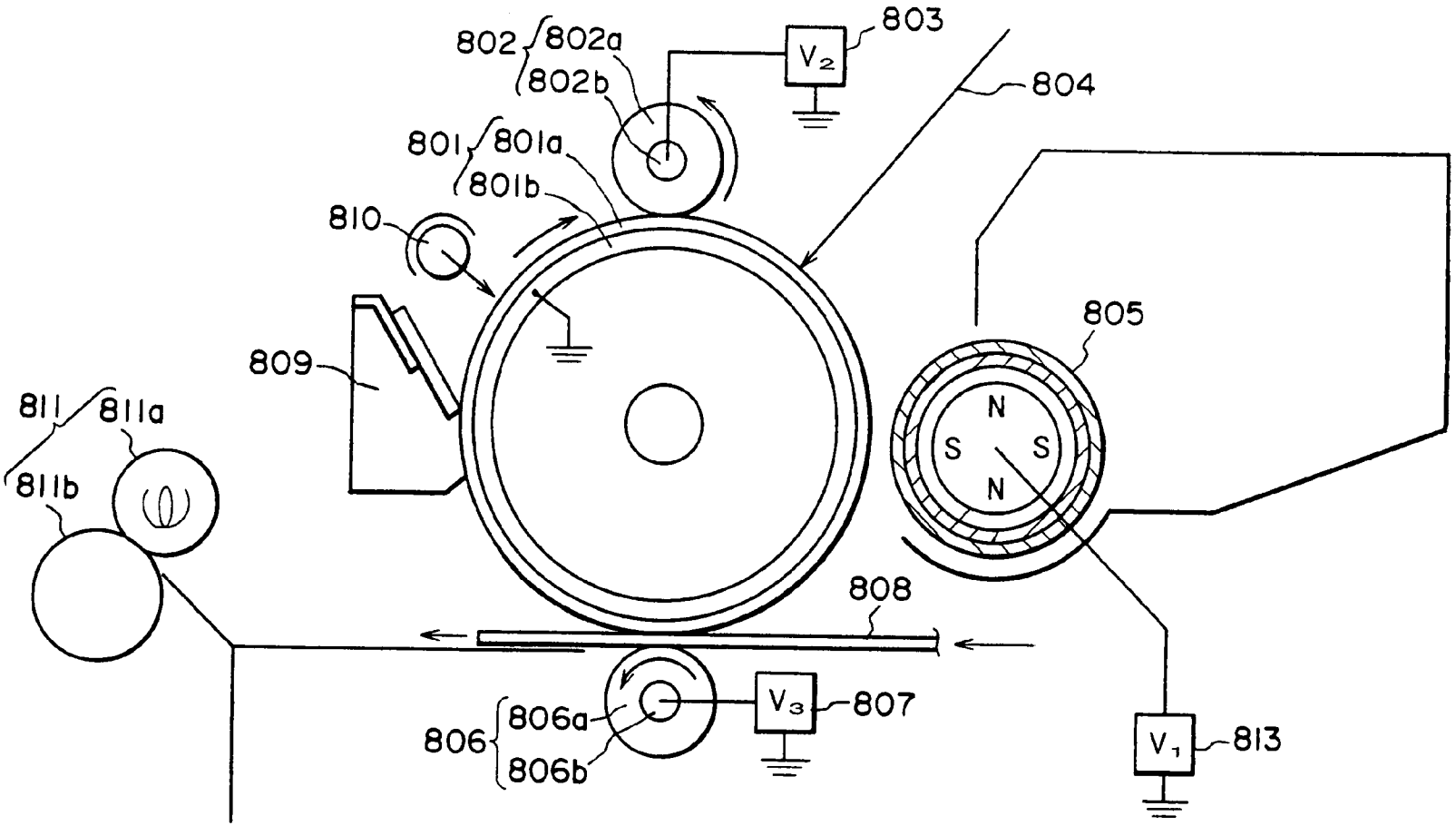
FIG. 4 is an illustration of an image forming apparatus to which the developing method according to the invention is applicable.

Referring to FIG. 4, a rotating drum-type photosensitive member 801 comprising a photoconductor layer 801*a* and an electroconductive substrate 801*b* is rotated at a prescribed peripheral speed (process speed) in a clockwise direction as shown on the drawing. A charging roller 802 comprising an electroconductive elastic layer 802*a* and a core metal 802*b* is supplied with a bias voltage V2 from a charging bias voltage supply 803. The charging roller 802 is pressed against the photosensitive member 801 and is rotated following the rotation of the photosensitive member 801.

Based on the bias voltage applied to the charging roller 802, the surface of the photosensitive member 801 is charged to a prescribed voltage of a prescribed polarity. Then, the charged photosensitive member 801 is exposed to image light 804 to form an electrostatic latent image thereon, which is then visualized as a toner image by a developing means 805. The developing means 805 includes a developing sleeve which is supplied with a bias voltage V1 from a developing bias voltage supply 813.

The toner image formed on the photosensitive member 801 is electrostatically transferred onto a transfer-receiving material 808 under the action of a transfer bias voltage V3 supplied from a voltage supply 807 via a transfer roller 806 (as a contact transfer means for pressing the transfer-receiving material 808 onto the photosensitive member 801) comprising an electroconductive elastic layer 806*a* and a core metal 806*b*. The toner image transferred onto the transfer-receiving material 808 is then fixed onto the transfer-receiving material 808 under application of heat and pressure by a heat-pressure fixing means 811 comprising a heating roller 811*a* and a pressure roller 811*b*. The surface of the photosensitive member 801 is subjected to cleaning for removal of attached soiling substance, such as transfer residual toner by a cleaning device 809 having an elastic cleaning blade abutted against the photosensitive member 801 in a counter direction, and then charge-removed by a charge-removing exposure means 810, to be used for a subsequent cycle of image formation.

While the charging roller 802 has been described as a contact charging means in the above embodiment, the primary charging means can also comprise another contact charging means, such as a charging blade or a charging brush, or alternatively a non-contact corona charging means. However, the contact charging means is less liable to cause the generation of ozone.

Further, while the transfer roller 806 has been described, the transfer means can also comprise another contact transfer means, such as a transfer blade or a transfer belt, or alternatively a non-contact corona transfer means. The contact transfer means is less liable to cause the occurrence of ozone.

Figure 5:
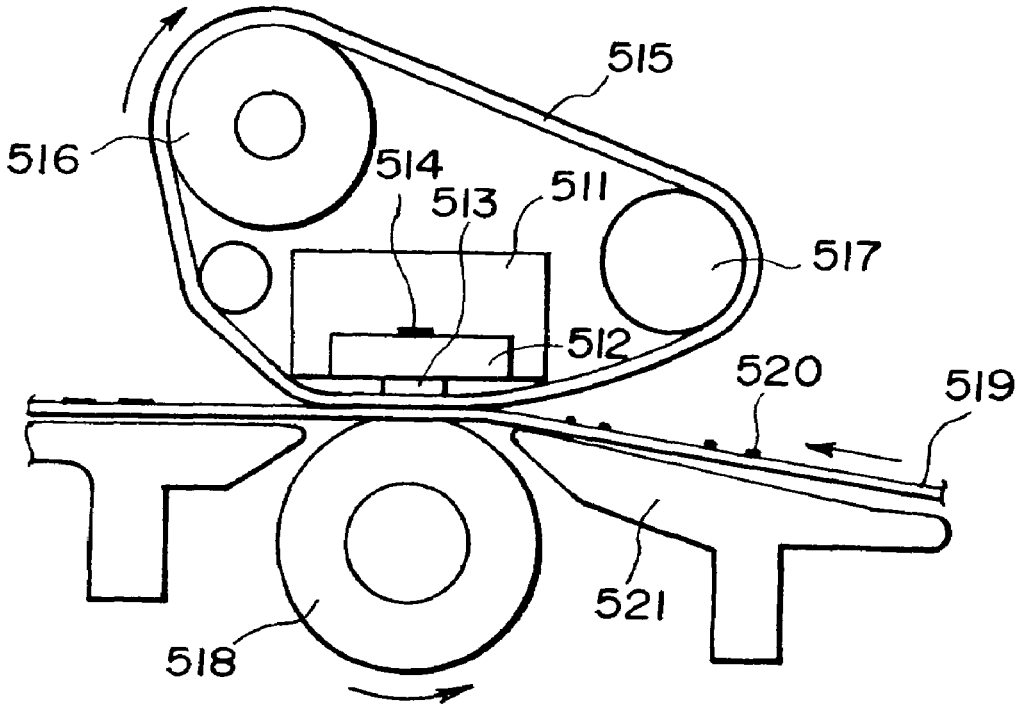
FIG. 5 is a schematic illustration of a film heat-fixing device as another heat-fixing means usable in an embodiment of the image forming method of the present invention.

In the image forming method according to the present invention, the heat-pressure fixing means used in a fixing step can be replaced a film heat-fixing device as another heat-fixing means. FIG. 5 shows an example of such a film heat-fixing device, wherein a transfer material 519 carrying thereon an unfixed toner image is passed between oppositely disposed heating member 511 and pressing member 518 via a fixing film 515 under a prescribed pressure to obtain a fixed toner image.

Referring to FIG. 5, the fixing device includes the heating member 511 which has a heat capacity smaller than that of a conventional hot roller and has a linear heating part exhibiting a maximum temperature of preferably 100-300° C.:

The fixing film 515 disposed between the heating member 511 and the pressing member 518 (pressing roller in this case) may preferably comprise a heat-resistant sheet having a thickness of 1-100 μm. The heat-resistant sheet may comprise a sheet of a heat-resistant polymer, such as polyester, PET (polyethylene terephthalate), PFA (tetrafluoro-ethylene-perfluoroalkyl vinyl ether copolymer), PTFE (polytetrafluoroethylene), polyimide, or polyamide; a sheet of a metal such as aluminum, or a laminate of a metal sheet and a polymer sheet.

The fixing film 515 may preferably have a release layer and/or a low resistivity layer on such a heat-resistant sheet.

An specific embodiment of the fixing device will be described with reference to FIG. 5.

The device includes a low-heat capacity linear heating member 511, which may for example comprise an aluminum substrate 512 of 1.0 mm-t×10 mm-W×240 mm-L, and a resistance material 513 which has been applied in a width of 1.0 mm on the aluminum substrate and is energized from both longitudinal ends. The energization is performed by applying pulses of DC 100 V and a cycle period of 20 msec while changing the pulse widths so as to control the evolved heat energy and provide a desired temperature depending on the output of a temperature sensor 514. The pulse width may range from ca. 0.5 msec to 5 msec. In contact with the heating member 511 thus controlled with respect to the energy and temperature, a fixing film 515 is moved in the direction of an indicated arrow.

The fixing film 515 may for example comprise an endless film including a 20 μm-thick heat-resistant film (of, e.g., polyimide, polyether imide, PES or PFA, provided with a coating of a fluorine-containing-resin such as PTFE or PAF on its image contact side) and a 10 μm-thick coating release layer containing an electroconductive material therein. The total thickness may generally be less than 100 μm, preferably less than 40 μm. The film is driven in the arrow direction under tension between a drive roller 516 and a mating roller 517.

The fixing device further includes a pressure roller 518 having a releasable elastomer layer of, e.g., silicone rubber and pressed against the heating member 511 via the film 515 at a total pressure of 4-20 kg, while moving together with the film 515 in contact therewith. A transfer material 519 carrying an unfixed toner image 520 is guided along an inlet guide 521 to the fixing station to obtain a fixed image by the heating described above.

The above-described embodiment includes a fixing film 515 in the form of an endless belt but the film can also be an elongated sheet driven between a sheet supply axis and a sheet winding axis.

Figure 11:
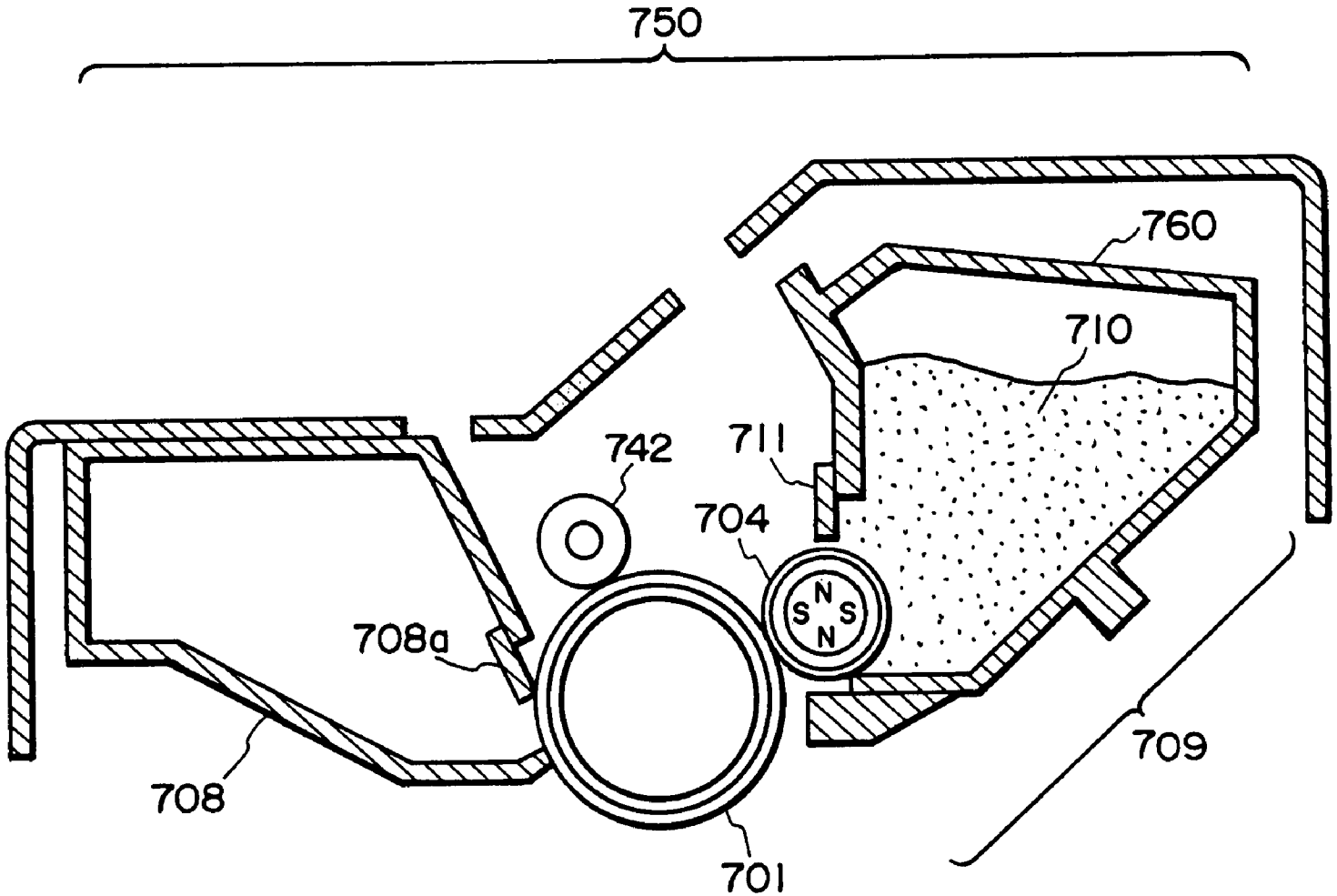
FIG. 11 is a schematic sectional illustration of a process-cartridge of the invention.

An embodiment of the process-cartridge according to the present invention is illustrated in FIG. 11. The process-cartridge according to the present invention generally comprises at least a developing means containing a toner of the present invention and an electrophotographic photosensitive member, which are integrally supported to form a process unit (process-cartridge) that is detachably mountable to a main assembly of an image forming apparatus (such as a copying machine or a laser beam printer).

Referring to FIG. 11, the process-cartridge 750 shown therein includes a developing means 709, a drum-shaped electrostatic image-bearing member (photosensitive drum) 701, a cleaner 708 equipped with a cleaning blade 708*a*, a primary charger (charging roller) 742 which are integrally supported to form the process-cartridge. The developing means 709 includes a developing sleeve 704 containing a magnet roll therein, a magnetic blade 711 and a toner vessel 760 containing a magnetic toner 710 according to the present invention. In developing operation, a prescribed electric field is formed between the photosensitive drum 701 and the developing sleeve 704 by applying a developing bias voltage from a bias voltage application means (not shown). For suitably practicing the developing under a stable bias electric field, it is very important to accurately control the gap between the photosensitive drum 701 and the developing sleeve 704.

The toner particles constituting the toner of the present invention may preferably be produced through a process wherein the above-mentioned toner ingredients including the binder resin, the colorant and the wax are sufficiently blended by means of a ball mill, a HENSCHEL mixer, etc. and then melt-kneaded by hot kneading means, such as a hot roller kneader or an extruder, and after being solidified by cooling, the melt-kneaded product is coarsely crushed and finely pulverized by the action of a jet stream or mechanically, followed by classification, to recover toner particles. Other production processes may include a polymerization toner production process wherein prescribed ingredients are blended with a monomer constituting the binder resin, and the resultant polymerizable mixture is suspended in an aqueous medium and polymerized to form toner particles; a microencapsule toner production process wherein prescribed ingredients are incorporated in either one or both of the core material and the shell material; and a spray drying process wherein a dispersion of prescribed ingredients in a binder resin solution is spray-dried to form toner particles. The thus-obtained toner particles are optionally blended with external additives as desired by a blender, such as a HENSCHEL mixer to obtain a toner of the present invention.

Next, a preferred process for producing the toner of the present invention will now be described with reference to the accompanying drawings. In the process, the toner ingredients comprising at least a binder resin and a colorant are melt-kneaded, and the melt-kneaded product after cooling is coarsely crushed by a crushing means to obtain a powdery feed comprising the crushed product. In a pulverization and classification system shown in FIG. 6, such a powdery feed is introduced into a first metering feeder and then supplied from the first metering feeder to an inlet port of a mechanical pulverizer including at least a rotor comprising a rotating member affixed to a central rotation shaft, and a stator housing the rotor with a prescribed spacing from the rotor surface, so that an annular space given by the spacing is made airtight, and the rotor is rotated at a high speed to finely pulverize the coarsely pulverized material. Then, the fine pulverizate discharged out of the discharge port of the mechanical pulverization is introduced at a prescribed rate via a second metering feeder to a multi-division classifier wherein the fine pulverizate is pneumatically classified into at least a fine powder fraction, a medium powder fraction and a coarse powder fraction under the action of crossing gas streams and the Coanda effect. The classified coarse powder fraction is blended with the powdery feed for reintroduction into the mechanical pulverizer, and the classified medium powder fraction is recovered by toner particles.

Figure 6:
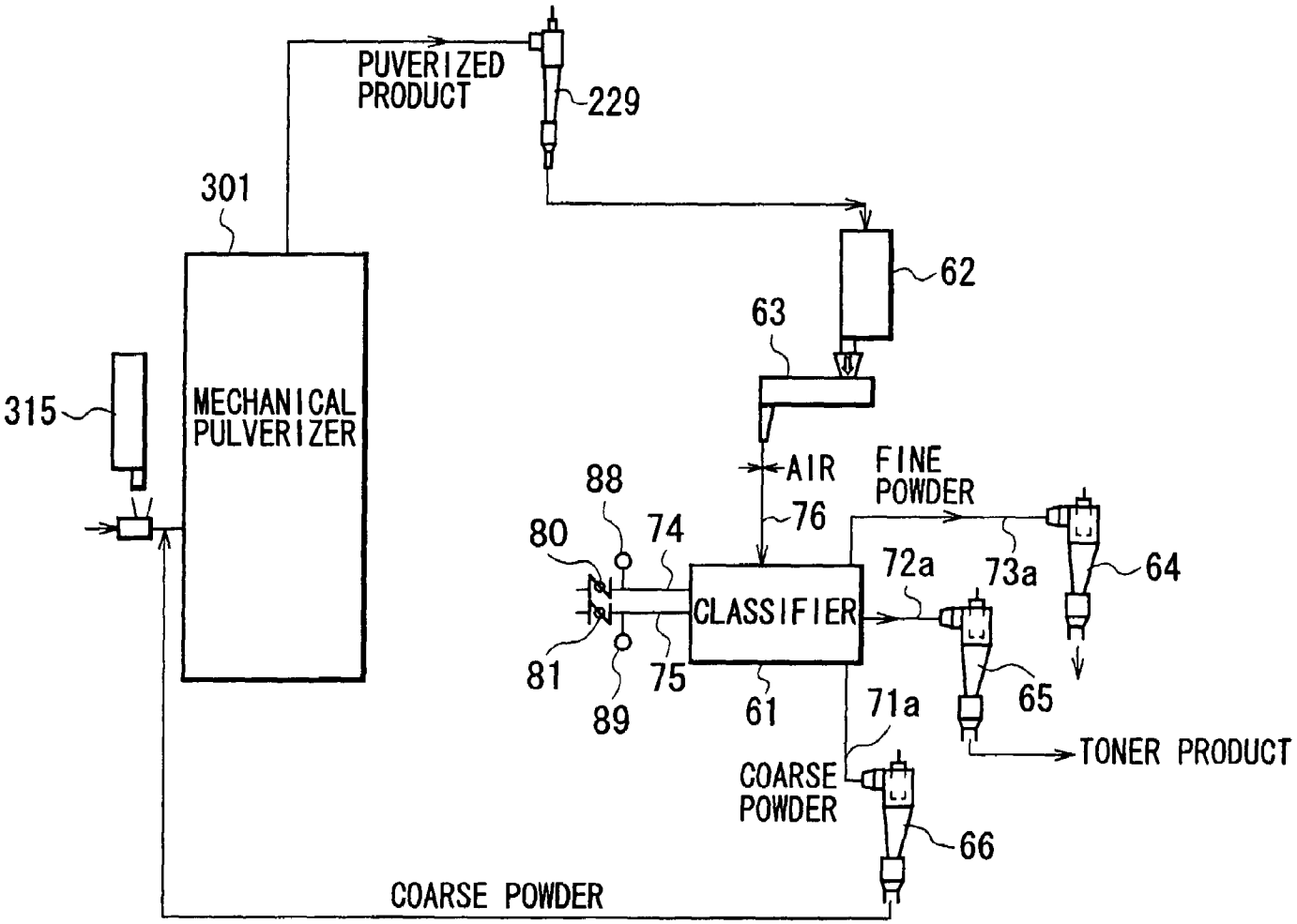
FIG. 6 illustrates an example of apparatus system for producing a toner of the invention.

More specifically, referring to FIG. 6, the powdery feed is introduced at a prescribed rate to a mechanical pulverizer 301 as pulverization means via a first metering feeder 315. The introduced powdery feed is instantaneously pulverized by the mechanical pulverizer 301, introduced via a collecting cyclone 229 to a second metering feeder 62 and then supplied to a multi-division pneumatic classifier 61 via a vibration feeder 63 and a feed supply nozzle 76.

In the apparatus system, the ratio between the feed rate to the mechanical pulverizer 301 from the first metering feeder 315 and the feed rate to the multi-division pneumatic classifier 61 via the second metering feeder 62, may preferably be set to 0.7-1.7 times, more preferably 0.7-1.5 times, further preferably 1.0-1.2 times, in view of the toner productivity and production efficiency.

Figure 10:
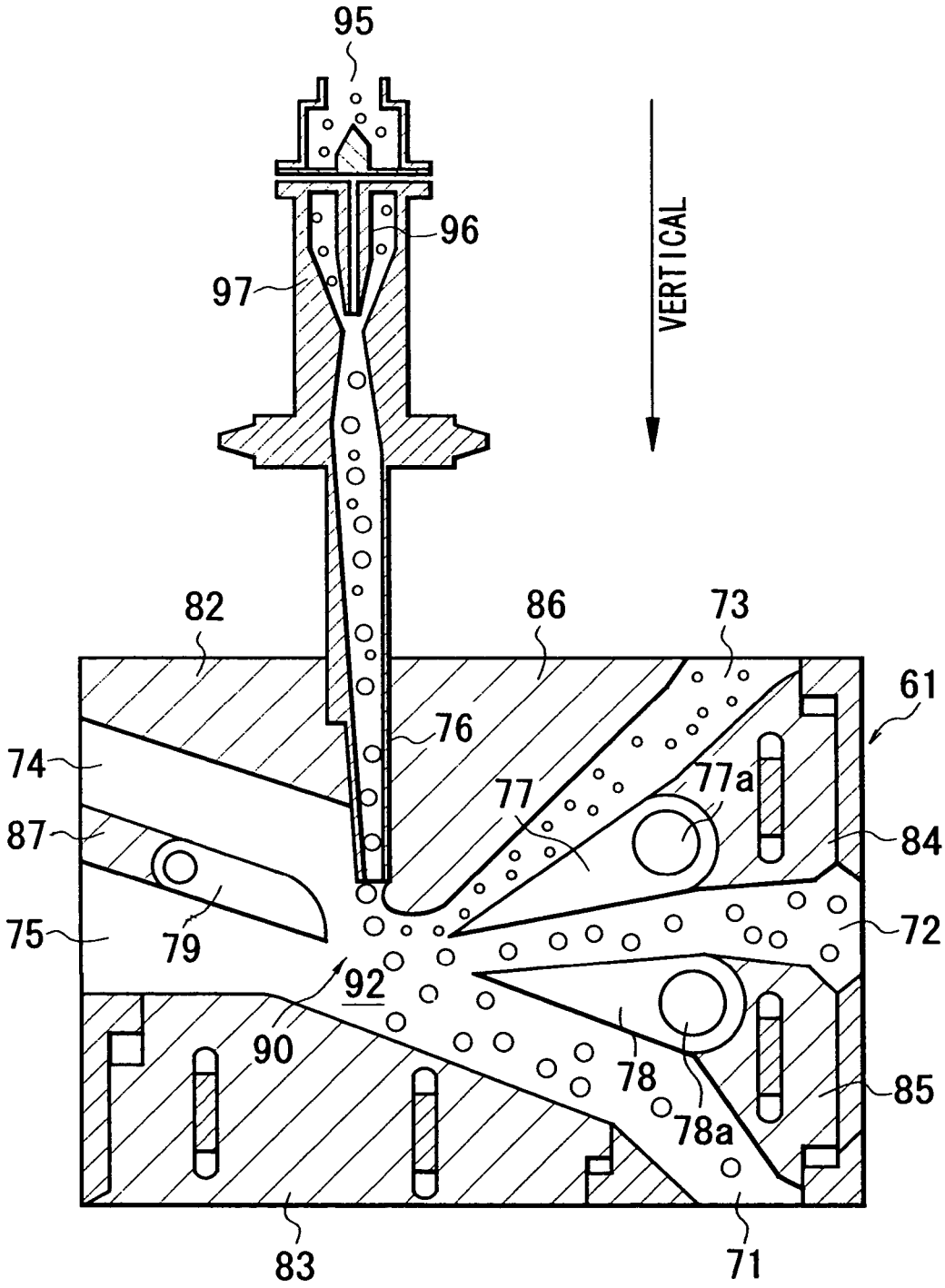
FIG. 10 is a schematic sectional view of a multi-division pneumatic classifier used in a toner classification-step.

A pneumatic classifier is generally incorporated in an apparatus system while being connected with other apparatus through communication means, such as pipes. FIG. 6 illustrates a preferred embodiment of such an apparatus system. The apparatus system shown in FIG. 6 includes the multi-division classifier 61 (the details of which are illustrated in FIG. 10), the metering feeder 62, the vibration feeder 63, and collecting cyclones 64, 65 and 66, connected by communication means.

In the apparatus system, the pulverized feed is supplied to the metering feeder 62 and then introduced into the three-division classifier 61 via the vibration feeder 63 and the feed supply nozzle 76 at a flow speed of 10-350 m/sec. The three-division classifier 61 includes a classifying chamber ordinarily measuring 10-50 cm×10-50 cm×3-50 cm, so that the pulverized feed can be classified into three types of particles in a moment of 0.1-0.01 sec or shorter. By the classifier 61, the pulverized feed is classified into coarse particles, medium particles and fine particles. Thereafter, the coarse particles are sent out of an exhaust pipe 71*a* to a collecting cyclone 66 and then recycled to the mechanical pulverizer 301. The medium particles are sent through an exhaust pipe 72*a* and discharge out of the system to be recovered by a collecting cyclone 65 as a toner product. The fine particles are discharged out of the system via an exhaust pipe 73*a* and are discharged out of the system to be collected by a collecting cyclone 64. The collected fine particles are supplied to a melt-kneading step for providing a powdery feed comprising toner ingredients for re-utilization, or are discarded. The collecting cyclones 64, 65 and 66 can also function as a suction vacuum generation means for introducing by suctioning the pulverized feed to the classifier chamber via the feed supply nozzle. The coarse particles classified out of the classifier 61 may preferably be recycled and mixed with a fresh powdery feed supplied from the first metering feeder 315 and re-pulverized in the mechanical pulverizer 301.

The rate of re-introduction of the coarse particles to the mechanical pulverizer 301 from the pneumatic classifier 61 may preferably be set to 0-10.0 wt. %, more preferably 0-5.0 wt. %, of the pulverized feed supplied from the second metering feeder 62 in view of the toner productivity. If the rate of re-introduction exceeds 10.0 wt. %, the powdery dust concentration in the mechanical pulverizer 301 is raised to increase the load on the pulverizer 301, and the toner productivity can be lowered due to difficulties, such as overpulverization heat causing toner surface deterioration, isolation of the magnetic iron oxide particles from the toner particles and melt-sticking onto the apparatus wall.

The powdery feed to the apparatus system may preferably have a particle size distribution such that at least 95 wt. % is 18 mesh-pass and at least 90 wt. % is 100 mesh-on (according to ASTM E-11-61).

In order to produce a toner having a weight-average particle size (D4) of at most 10 μm, preferably at most 8 μm, and a narrow particle size distribution, the pulverized product out of the mechanical pulverizer may preferably satisfy a particle size distribution including a weight-average particle size of 4-10 μm, at most 70% by number, more preferably at most 65% by number of particles of at most 4.0 μm, and at most 25% by volume, more preferably at most 20% by volume, of particles of at least 10.1 μm. Further, the medium particles classified out of the classifier 61 may preferably satisfy a particle size distribution including a weight-average particle size of 5-9 μm, at most 40% by number, more preferably at most 35% by number, of particles of at most 4.0 μm, and at most 40% by volume, more preferably at most 35% by volume, of particles of at least 10.1 μm.

The above-mentioned apparatus system does not include a first classification step, prior to the pulverization step, and includes a single pass of pulverization step and classification step.

The mechanical pulverizer 301 suitably incorporated in the apparatus system of FIG. 6 may be provided by a commercially available pulverizer, such as "KTM" (available from Kawasaki Jukogyo K. K.) or "TURBOMILL" (available from Turbo Kogyo K. K.), as it is, or after appropriate remodeling.

Figure 7:
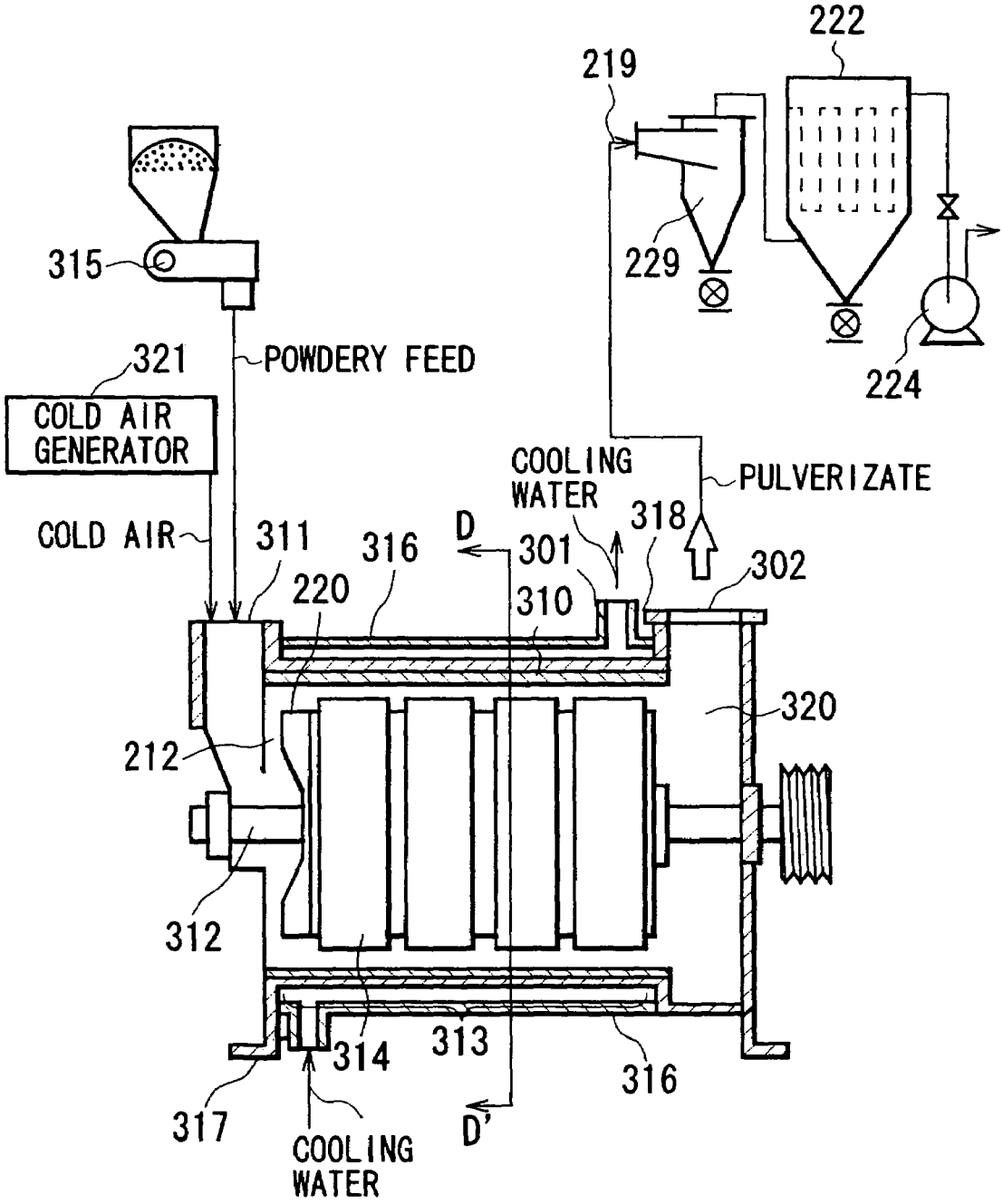
FIG. 7 is a schematic sectional view of a mechanical pulverizer used in a toner pulverization step.
Figure 8:
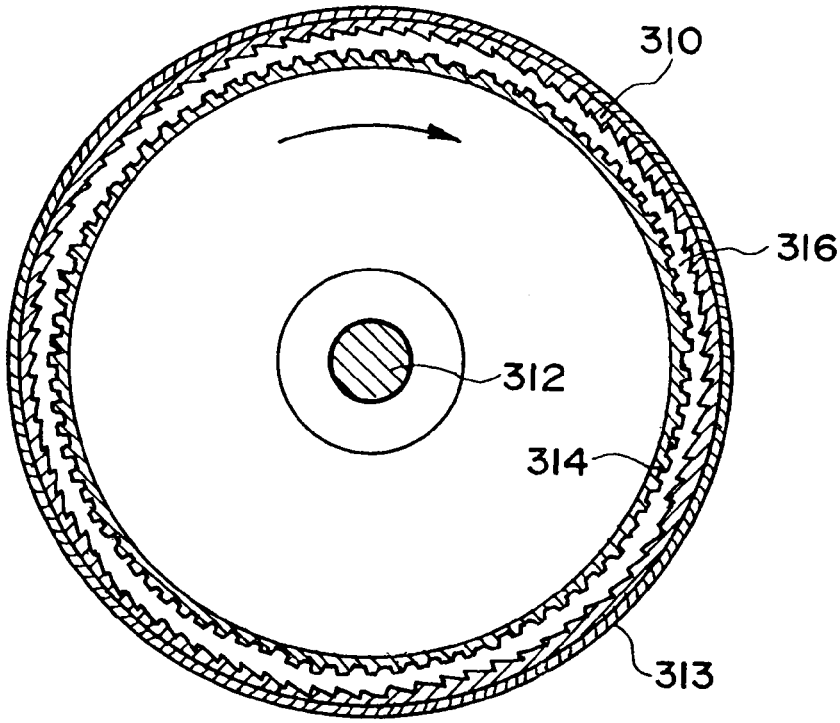
FIG. 8 is a schematic sectional view of a D-D' section in FIG. 7.
Figure 9:
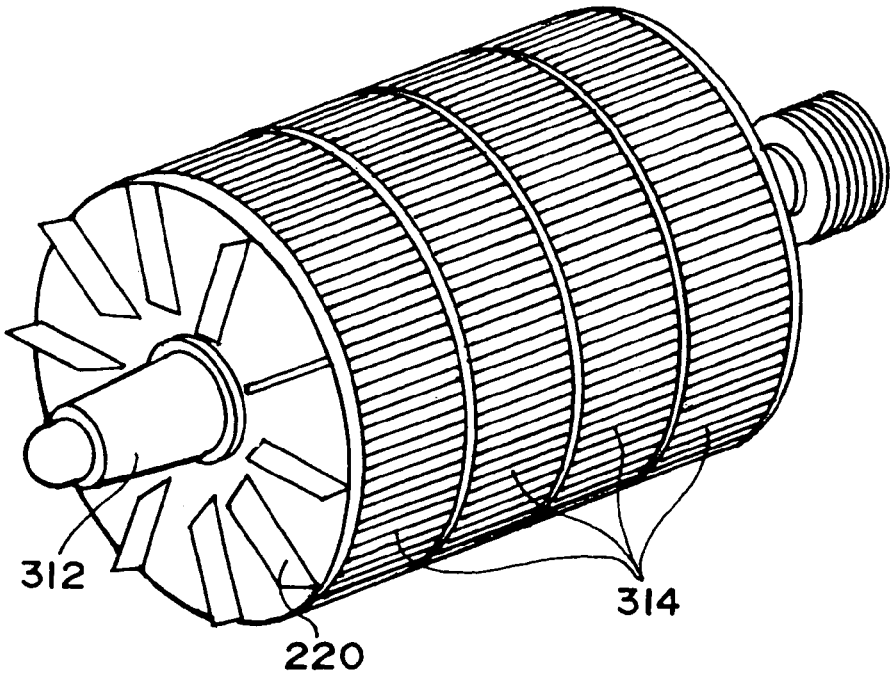
FIG. 9 is a perspective view of a rotor contained in the pulverizer of FIG. 7.

It is particularly preferred to adopt a process using a mechanical pulverizer as illustrated in FIGS. 7-9, so as to allow easy pulverization of the powdery feed and realize effective toner production.

Now, the organization of a mechanical pulverizer will be described with reference to FIGS. 7-9. FIG. 7 schematically illustrates a sectional view of a mechanical pulverizer; FIG. 8 is a schematic sectional view of a D-D' section in FIG. 7, and FIG. 9 is a perspective view of a rotor 314 in FIG. 7. As shown in FIG. 7, the pulverizer includes a casing 313; a jacket 316; a distributor 220; a rotor 314 comprising a rotating member affixed to a control rotation shaft 312 and disposed within the casing 313, the rotor 314 being provided with a large number of surface grooves (as shown in FIG. 9) and designed to rotate at a high speed; a stator 310 disposed with prescribed spacing from the circumference of the rotor 314 so as to surround the rotor 314 and provided with a large number of surface grooves; a feed port 311 for introducing the powdery feed; and a discharge port 302 for discharging the pulverized material.

In operation, a powdery feed is introduced at a prescribed rate from the feed port 311 into a processing chamber, where the powdery feed is pulverized in a moment under the action of an impact caused between the rotor 314 rotating at a high speed and the stator 310, respectively provided with a large number of surface grooves, a large number of ultra-high speed eddy flow occurring thereafter and a high-frequency pressure vibration caused thereby. The pulverized product is discharged out of the discharge port 302. Air conveying the powdery feed flows through the processing chamber, the discharge port 302, a pipe 219, a collecting cyclone 229, a bag filter 222 and a suction blower 224 to be discharged out of the system.

The conveying air is cold air generated by a cold air generation means 321 and introduced together with the powdery feed, and the pulverizer main body is covered with a jacket 316 for flowing cooling water (preferably, non-freezing liquid comprising ethylene glycol, etc.), so as to maintain the temperature within the processing chamber at 0° C. or below, more preferably −5 to −15° C., further preferably −7 to −12° C., in view of the toner productivity. This is effective for suppressing the surface deterioration of toner particles due to pulverization heat, particularly the liberation of magnetic iron oxide particles present at the toner particle surfaces and melt-sticking of toner particles onto the apparatus wall, thereby allowing effective pulverization of the powdery feed. The operation at a processing chamber temperature below −15° C. requires the use of flon (having a better stability at lower temperatures but regarded as less advisable from global viewpoint) instead of flon substitute as a refrigeration medium for the cold air generation means.

The cooling water is introduced into the jacket 316 via a supply port 317 and discharged out of a discharge port 318.

In the pulverization operation, it is preferred to set the temperature T1 in a whirlpool chamber 212 (inlet temperature) and the temperature T2 in a rear chamber 320 (outlet temperature) so as to provide a temperature difference ΔT (=T2−T1) of 30-80° C., more preferably 35-75° C., further preferably 37-72° C., thereby suppressing the surface deterioration of toner particle surfaces, and effectively pulverizing the powdery feed. A temperature difference ΔT of below 30° C. suggests a possibility of short pass of the powdery feed without effective pulverization thereof, thus being undesirable in view of the toner performances. On the other hand, ΔT>80° C. suggests a possibility of overpulverization, resulting in surface deterioration due to heat of the toner particles and melt-sticking of toner particles onto the apparatus wall and thus adversely affecting the toner productivity.

It is preferred that the inlet temperature (T1) in the mechanical pulverizer is set to at most 0° C. and a value which is lower than the glass transition temperature (Tg) of the binder resin by 60-75° C. As a result, it is possible to suppress the surface deterioration of toner particles due to heat, and allow effective pulverization of the powdery feed. Further, the outlet temperature (T2) may preferably be set to a value which is lower by 5-30° C., more preferably 10-20° C., than Tg. As a result, it becomes possible to suppress the surface deterioration of toner particles due to heat, and allow effective pulverization of the powdery feed.

The rotor 314 may preferably be rotated so as to provide a circumferential speed of 80-180 m/s, more preferably 90-170 m/s, further preferably 100-160 m/s. As a result, it becomes possible to suppress insufficient pulverization or overpulverization, and allow effective pulverization of the powdery feed. A circumferential speed below 80 m/s of the rotor 314 is liable to cause a short pass without pulverization of the feed, thus resulting in inferior toner performances. A circumferential speed exceeding 180 m/s of the rotor invites an overload of the apparatus and is liable to cause overpulverization resulting in surface deterioration of toner particles due to heat, and also melt-sticking of the toner particles onto the apparatus wall, thus adversely affecting the toner productivity.

Further, the rotor 314 and the stator 310 may preferably be disposed to provide a minimum gap therebetween of 0.5-10.0 mm, more preferably 1.0-5.0 mm, further preferably 1.0-3.0 mm. As a result, it becomes possible to suppress insufficient pulverization or overpulverization and allow effective pulverization of the powdery feed. A gap exceeding 10.0 mm between the rotor 314 and the stator 310 is liable to cause a short pass without pulverization of the powdery feed, thus adversely affecting the toner performance. A gap smaller than 0.5 mm invites an overload of the apparatus and is liable to cause overpulverization resulting in surface deterioration of toner particles due to heat, and also melt-sticking of the toner particles onto the apparatus wall, thus adversely affecting the toner productivity.

The effective pulverization achieved by the above-mentioned mechanical pulverizer allows the omission of a pre-classification step liable to result in overpulverization and omission of the large-volume pulverization air supply required in the pneumatic pulverizer.

Next, a pneumatic classifier as a preferred classification means for toner production, will be described.

FIG. 10 is a sectional view of an embodiment of a preferred multi-division pneumatic classifier.

Referring to FIG. 10, the classifier includes a side wall 82 and a G-block 83 defining a portion of the classifying chamber, and classifying edge blocks 84 and 85 equipped with knife edge-shaped classifying edges 77 and 78. The G-block 83 is disposed slidably laterally. The classifying edges 77 and 78 are disposed swingably about shafts 77*a* and 78*a* so as to change the positions of the classifying edge tips. The classifying edge blocks 77 and 78 are slidable laterally so as to change horizontal positions relatively together with the classifying edges 77 and 78. The classifying edges 77 and 78 divide a classification zone 90 of the classifying chamber 92 into 3 sections.

A feed port 95 for introducing a powdery feed is positioned at the nearest (most upstream) position of a feed supply nozzle 76, which is also equipped with a high-pressure air nozzle 96 and a powdery feed-introduction nozzle 97 and opens into the classifying chamber 92. The nozzle 76 is disposed on a right side of the side wall 82, and a Coanda block 86 is disposed so as to form a long elliptical arc with respect to an extension of a lower tangential line of the feed supply nozzle 76. A left block 87 with respect to the classifying chamber 92 is equipped with a gas-intake edge 79 projecting rightwards in the classifying chamber 92. Further, gas-intake pipes 74 and 75 are disposed on the left side of the classifying chamber 92 so as to open into the classifying chamber 92. Further, the gas-intake pipes 74 and 75 are equipped with first and second gas introduction control means 80 and 81, like dampers, and static pressure gauges 88 and 89 (as shown in FIG. 6).

The positions of the classifying edges 77 and 78, the G-block 83 and the gas-intake edge 78 are adjusted depending on the pulverized powdery feed to the classifier and desired particle size of the product toner.

On the right side of the classifying chamber 92, there are disposed exhaust ports 71, 72 and 73 communicative with the classifying chamber corresponding to respective classified fraction zones. The exhaust ports 71, 72 and 73 are connected with communication means such as pipes (71*a*, 72*a* and 73*a* as shown in FIG. 6) which can be provided with shutter means, such as valves, as desired.

The feed supply nozzle 76 may comprise an upper straight tube section and a lower tapered tube section. The inner diameter of the straight tube section and the inner diameter of the narrowest part of the tapered tube section may be set to a ratio of 20:1 to 1:1, preferably 10:1 to 2:1, so as to provide a desirable introduction speed.

The classification by using the above-organized multi-division classifier may be performed in the following manner. The pressure within the classifying chamber 92 is reduced by evacuation through at least one of the exhaust ports 71, 72 and 73. The powdery feed is introduced through the feed supply nozzle 76 at a flow speed of preferably 10-350 m/sec under the action of a flowing air caused by the reduced pressure and an ejector effect caused by compressed air ejected through the high-pressure air supply nozzle and ejected to be dispersed in the classifying chamber 92.

The particles of the powdery feed introduced into the classifying chamber 92 are caused to flow along curved lines under the action of the Coanda effect exerted by the Coanda block 86 and the action of introduced gas, such as air, so that coarse particles form an outer stream to provide a first fraction outside the classifying edge 78, medium particles form an intermediate stream to provide a second fraction between the classifying edges 78 and 77, and fine particles form an inner stream to provide a third fraction inside the classifying edge 77, whereby the classified coarse particles are discharged out of the exhaust port 71, the medium particles are discharged out of the exhaust port 72 and the fine particles are discharged out of the exhaust port 73, respectively.

In the above-mentioned powder classification, the classification (or separation) points are principally determined by the tip positions of the classifying edges 77 and 78 corresponding to the lowermost part of the Coanda block 86, while being affected by the suction flow rates of the classified air stream and the powder ejection speed through the feed supply nozzle 76.

Some physical properties of a toner described herein are based on the results of measurement methods described below.

(1) Acid Values of a Toner and a Binder Resin

Measured according to JIS K0070.

Apparatus: Automatic potentiometric titration apparatus ("AT-400", made by Kyoto Denshi K. K.)

Calibration of apparatus: Performed by using a solvent mixture of toluene 120 ml and ethanol 30 ml.

Measurement temperature: 25° C.

Measurement operation including sample preparation is as follows.

(i) Ca. 1.0 g of a toner or ca. 0.5 g of a binder resin is accurately weighed at W (g) and placed in a 200 ml-beaker, and then 120 ml of toluene is added thereto, followed by stirring by a magnetic stirrer for ca. 10 hours at room temperature (25° C.) for dissolution. Then, 30 ml of ethanol is added thereto to form a toluene/methanol mixture solution as a sample solution. Separately, a mixture of toluene (120 ml) and ethanol (30 ml) is prepared as a blank solution.

(ii) The blank solution is titrated with a 0.1 ml/liter-KOH solution in ethanol having a factor of f, and the amount of the KOH solution used for the titration is measured and recorded at B (ml).

(iii) The sample solution is titrated with the same 0.1 mol/liter-KOH solution, and the amount of the KOH solution, and the amount of the KOH solution used for the titration is recorded at S (ml).

(iv) The acid value of the sample is calculated according to the following equation:

$$\text{Acid value(mgKOH/g)}=\{(S-B)\times f\times 5.61\}\times W.$$

(2) Molecular Weight (Distribution) of THF-Soluble Content

Measured according to the GPC method for a molecular weight range of at least 800.

In the GPC apparatus, a column is stabilized in a heat chamber at 40° C., tetrahydrofuran (THF) solvent is caused to flow through the column at that temperature at a rate of 1 ml/min., and ca. 100 μl of a sample solution in THF is injected. The identification of sample molecular weight and its distribution is performed based on a calibration curve obtained by using several monodisperse polystyrene samples and having a logarithmic scale of molecular weight versus count number. The standard polystyrene samples may be available from, e.g., Toso K. K. or Showa Denko. It is appropriate to use at least 10 standard polystyrene samples having molecular weights ranging from ca. $10^2$ to ca. $10^7$. The detector may be an RI (refractive index) detector. It is appropriate to constitute the column as a combination of several commercially available polystyrene gel columns. For example, it is possible to use a combination of Shodex GPC KF-801, 802, 803, 804, 805, 806, 807 and 808P available from Showa Denko K. K.; or a combination of TSKgel G1000H ($H_{XL}$), G2000H ($H_{XL}$), G3000H ($H_{XL}$), G4000H ($H_{XL}$), G5000H ($H_{XL}$), G7000H ($H_{XL}$) and TSKguard column available from Toso K. K.

Based on the thus-obtained molecular weight, a proportion of a component in a molecular weight region of at least $10^5$ to a component in ia molecular weight region of at least 800 is calculated to determine the former content (% ($\geqq 10^5$)).

A GPC sample solution is prepared in the following manner.

A binder resin sample is dissolved in THF after being passed through a roll mill for 15 min. at 100° C.

A toner sample is added to THF and left standing for several hours. Then, the mixture is well shaked until the sample mass disappears and further left to stand still for at least 24 hours. Then, the mixture is caused to pass through a sample treatment filter having a pore size of 0.2-0.5 μm (e.g., "MAISHORI DISK H-25-2", available from Toso K. K.) to obtain a GPC sample having a resin concentration of 0.5-5 mg/ml.

(3) Determination of a Hybrid Binder Resin Content in a Toner According to $^{13}$C-NMR (Nuclear Magnetic Resonance)

Measurement may be performed by using an FT-NMR (Fourier transform-nuclear magnetic resonance) apparatus ("JNM-EX400", available from Nippon Denshi K. K.) under the following conditions.

Measurement frequency: 100.40 MHz

Pulse condition: 5.0 μsec (45 deg.) according to the DEPT method

Data points: 32768

Delay time: 25 sec.

Integration times: 50000 times

Temperature: 26° C.

Sample: Prepared by adding 10 g of a toner to 100 ml of conc. (ca. 12M) hydrochloric acid and stirring the mixture for ca. 70 hours at room temperature to dissolve a magnetic material contained therein, followed by repetition of filtration and washing with water until the filtrate becomes weakly acidic (ca. pH 5), and vacuum drying of the residual resin at 60° C. for ca. 20 hours. Ca. 1 g of the sample resin is placed in a 10 mm-dia. sample tube and dissolved by adding 3 ml of deuterium chloroform ($CDCl_3$) and standing at 55° C. in a thermostat vessel.

(4) Rheological Properties of a Toner and a Binder

Measured by using a viscoelasticity meter ("RHEOMETER RDA-II", made by Rheometrics Co.) under the following conditions.

Sample holder: Parallel plates of 7.9 mm in diameter for a high-elastic modulus sample or 25 mm in diameter for a low-elastic modulus sample.

Sample: A toner or a binder resin is heat-melted and molded into a cylindrical sample of ca. 8 mm in diameter and 2-5 mm in height or a disk sample of ca. 25 mm in diameter and ca. 2-3 mm in height.

Measurement frequency: 6.28 radian/sec.

Strain set: Initially set at 0.1%, followed by measurement according to an automatic measurement mode.

Correction of sample elongation: Adjusted according to an automatic measurement mode.

Temperature: Raised at a rate of 1° C./min. from 25° C. to 150° C.

(5) THF (Tetrahydrofuran)-Insoluble Content

Ca. 0.5-1.0 g of a sample toner is accurately weighed at W1 (g), placed in a cylindrical filter paper ("No. 86R", having a size of 28 mm in diameter and 100 mm in height, available from Toyo Roshi K. K.) and set on a Soxhlet's extractor, followed by 10 hours of extraction with 200 ml of solvent THF on an oil bath adjusted at ca. 120-130° C. so as to allow one refluxing cycle in 120 to 150 sec. The filter paper after the extraction is dried for 10 hours at 70° C. under a reduced pressure to determine a THF-soluble content (W2). A THF-insoluble content in the binder resin is determined based on a THF-insoluble matter weight (W3) other than the binder resin, i.e., the colorant (or/and the magnetic material), etc., according to the following equation:

$$\text{THF-insoluble content(wt. \%)}=[((W1-(W2+W3))/(W1-W2)]\times 100.$$

(6) DSC Curve of a Toner and Heat-Absorption Peak Temperature (Tabs) of a wax

Measurement may be performed in the following manner by using a differential scanning calorimeter ("DSC-7", available from Perkin-Elmer Corp.) according to ASTM D3418-82.

A sample in an amount of ca. 5-20 mg, preferably ca. 10 mg, is accurately weighed. The sample is placed on an aluminum pan and subjected to measurement in a temperature range of 30-200° C. at a temperature-raising rate of 10° C./min in parallel with a blank aluminum pan as a reference. In the course of temperature increase, a main absorption peak appears at a temperature in the range of 40-100° C. on a DSC curve. The temperature is taken as a heat-absorption peak temperature (Tabs).

(7) Glass Transition Temperature (Tg) of a Binder Resin

Measurement may be performed in the following manner by using a differential scanning calorimeter ("DSC-7", available from Perkin-Elmer Corp.) according to ASTM D3418-82.

A sample in an amount of 5 mg is accurately weighed.

The sample is placed on an aluminum pan and subjected to measurement in a temperature range of 30-200° C. at a temperature-raising rate of 10° C./min in a normal temperature-normal humidity environment in parallel with a blank aluminum pan as a reference.

In the course of temperature increase, a main absorption peak appears in the temperature region of 40-100° C.

In this instance, the glass transition temperature (Tg) is determined as a temperature of an intersection between a DSC curve and an intermediate line drawn at equal distances from the base lines obtained before and after the appearance of the absorption peak.

(8) Molecular Weight Distribution of a Wax

The molecular weight (distribution) of a wax may be measured by GPC under the following conditions:

Apparatus: "GPC-150C" (available from Waters Co.)

Column: "GMH-HT" 30 cm-binary (available from Toso K. K.)

Temperature: 135° C.

Solvent: o-dichlorobenzene containing 0.1% of ionol.

Flow rate: 1.0 ml/min.

Sample: 0.4 ml of a 0.15%-sample.

Based on the above GPC measurement, the molecular weight distribution of a sample is obtained once based on a calibration curve prepared by monodisperse polystyrene standard samples, and re-calculated into a distribution corresponding to that of polyethylene by using a conversion formula based on the Mark-Houwink viscosity formula.

(9) Particle Size Distribution of a Toner

COULTER counter Model TA-II or COULTER MULTISIZER (available from Coulter Electronics Inc.) may be used as an instrument for measurement. For measurement, a 1%-NaCl aqueous solution as an electrolyte solute is prepared by using a reagent-grade sodium chloride (e.g., Isoton® II", available from Coulter Scientific Japan Co. may be commercially available). To 100 to 150 ml of electrolyte solution, 0.1 to 5 ml of a surfactant, preferably an alkylbenzenesulfonic acid salt, is added as a dispersant, and 2 to 20 mg of a sample is added thereto. The resultant dispersion of the sample in the electrolyte liquid is subjected to a dispersion treatment for about 1-3 minutes by means of an ultrasonic disperser, and then subjected to measurement of particle size distribution in the range of 2-40 μm by using the above-mentioned apparatus with a 100 micron-aperture to obtain a volume-bias distribution and a number-basis distribution. From the results of the volume-basis distribution, the weight-average particle size (D4) and volume-average particle size (Dv) of the toner may be obtained (while using a central value for each channel as the representative value of the channel).

The following 13 channels are used: 2.00-2.52 μm, 2.52-3.17 μm, 3.17-4.00 μm, 4.00-5.04 μm, 5.04-6.35 μm, 6.35-8.00 μm, 8.00-10.08 μm, 10.08-12.70 μm, 12.70-16.00 μm, 16.00-20.20 μm, 20.20-25.40 μm, 25.40-32.00 μm and 32.00-40.32 μm with the proviso that the upper limit value is not included for each channel.

EXAMPLES

Hereinbelow, the present invention will be described more specifically based on Examples, which however should not be construed to restrict in any way the scope of the present invention.

<Hybrid Resins>

Production Example 1

Starting ingredients including: 100 wt. parts of Endcapped Polyester (A-1) (formed by end-capping Polyester (1) formed of 34 mol. % of terephthalic acid, 4 mol. % of fumaric acid, 38 mol. % of bisphenol A derivative of the before-mentioned formula (2) (R=ethylene, x+y=2.4), 7 mol. % of bisphenol A derivative of the formula (2) (R=propylene, x+y=2.2) and 2 mol. % of trimellitic anhydride with 15 mol. % of benzoic acid as the endcapper for hydroxyl group of Polyester (1)) and 200 wt. parts of xylene, were placed in a reaction vessel equipped with a reflux pipe, a stirrer, a thermometer, a nitrogen-intake pipe, a dropping device and a vacuum device, and the inner temperature of the reaction vessel was raised to 115-120° C. while introducing nitrogen to dissolve Polyester (A-1) in the xylene. Incidentally, Endcapped Polyester (A-1) exhibited a main peak molecular weight (Mp) of 6500, a glass transition temperature (Tg) of 50° C., an acid value ($V_A$) of 26 mgKOH/g and a hydroxyl value ($V_{OH}$) of 14 mgKOH/g.

Then, into the reaction vessel, a vinyl monomer mixture for providing a vinyl polymer unit including 69 wt. parts of styrene, 21 wt. parts of butyl acrylate, 10 wt. parts of monobutyl maleate, 4 wt. parts of di-t-butyl peroxide (polymerization initiator) and 14 wt. parts of Wax (1) shown in Table 3 appearing hereinafter was added, and the system was subjected to 8 hours of radical polymerization, followed by distilling-off of the xylene under a reduced pressure to obtain a resin composition including a hybrid resin (1) comprising unsaturated polyester grafted with a vinyl polymer, a hybrid resin (2) formed by esterification of the hydroxyl group of the hybrid resin (1) with an acid anhydride formed by isolation of butanol from the monobutyl maleate unit of the vinyl polymer, a hybrid resin (3) formed by esterification of the hydroxyl group of the hybrid resin (1) with the carboxyl group of the trimellitic anhydride of the polyester, and Wax (1). The resin composition exhibited Mp=6600, Tg=56° C., $V_A$=21 mgKOH/g, and a THF-insoluble content ($THF_{ins}$) of 41%, and is hereinafter called Hybrid resin (H-1).

Production Example 2

Hybrid resin (H-2) was prepared in the same manner as in Production Example 1 except for omitting Wax (1) from the vinyl monomer mixture for providing the vinyl polymer unit.

Production Example 3

Starting ingredients including: 100 wt. parts of Endcapped Polyester (A-2) formed by end-capping Polyester (1) formed of 40 mol. % of terephthalic acid, 4 mol. % of fumaric acid, 23 mol. % of bisphenol A derivative of the before-mentioned formula (2) (R=ethylene, x+y=2.4), and 23 mol. % of bisphenol A derivative of the formula (2) (R=propylene, x+y=2.2) with 8.3 mol. % of benzoic acid as the endcapper for hydroxyl group of Polyester (2)) and 200 wt. parts of xylene, were placed in a reaction vessel equipped with a reflux pipe, a stirrer, a thermometer, a nitrogen-intake pipe, a dropping device and a vacuum device, and the inner temperature of the reaction vessel was raised to 115-120° C. while introducing nitrogen to dissolve Polyester (A-2) in the xylene. Incidentally, Endcapped Polyester (A-1) exhibited Mp=6500, Tg=54° C., $V_A$=28 mgKOH/g and $V_{OH}$=37 mgKOH/g.

Then, into the reaction vessel, a vinyl monomer mixture including 37 wt. parts of styrene, 21 wt. parts of butyl acrylate, 6 wt. parts of monobutyl maleate, 2 wt. part of di-t-butyl peroxide (polymerization initiator) and 14 wt. parts of Wax (1) was added, and followed thereafter by the same procedure as in Production Example 1 to obtain Hybrid resin (H-3), which exhibited Mp=11500, Tg=58° C., $V_A$=19 mgKOH/g, and $THF_{ins}$=31.1%.

Production Example 4

Hybrid resin (H-4) was prepared in the same manner as in Production Example 1 except for replacing Polyester (1) with Polyester (3) formed of 33 mol. % of terephthalic acid, 4 mol. % of fumaric acid, 37 mol. % of bisphenol A derivative of the formula (2) (R=ethylene, x+y=2.4), 7 mol. % of bisphenol A derivative of the formula (2) (R=propylene, x+y=2.2) and 3 mol. % of trimellitic anhydride. Hybrid resin (H-4) exhibited Mp=6700, Tg=60° C., $V_A$=34 mgKOH/g, $V_{OH}$=14 mgKOH/g, and $THF_{ins}$=46%.

Production Example 5

Hybrid resin (H-5) was prepared in the same manner as in Production Example 1 except for replacing Polyester (1) with Polyester (4) formed of 32 mol. % of terephthalic acid, 4 mol. % of fumaric acid, 37 mol. % of bisphenol A derivative of the formula (2) (R=ethylene, x+y=2.4), 7 mol. % of bisphenol A derivative of the formula (2) (R propylene, x+y=2.2) and 4 mol. % of trimellitic anhydride. Hybrid resin (H-5) exhibited Mp=6900, Tg=61° C., $V_A$=34 mgKOH/g, $V_{OH}$=12 mgKOH/g, and $THF_{ins}$=54%.

Production Example 6

Hybrid resin (H-6) was prepared in the same manner as in Production Example 1 except for replacing the vinyl monomer mixture for providing the vinyl polymer unit with a mixture including 72 wt. parts of styrene, 22 wt. parts of butyl acrylate, 6 wt. parts of monobutyl maleate, 4 wt. parts of di-t-butyl peroxide and 14 wt. parts of Wax (1). Hybrid resin (H-6) exhibited Mp=6300, Tg=58° C., $V_A$=23 mgKOH/g and $THF_{ins}$=25%.

Production Example 7

Hybrid resin (H-7) was prepared in the same manner as in Production Example 1 except for replacing the vinyl monomer mixture for providing the vinyl polymer unit with a mixture including 70 wt. parts of styrene, 21 wt. parts of butyl acrylate, 8 wt. parts of monobutyl maleate, 4 wt. parts of di-t-butyl peroxide and 14 wt. parts of Wax (1). Hybrid resin (H-7) exhibited Mp 6500, Tg=59° C., $V_A$=28 mgKOH/g and THFins=29%.

Production Examples 8-10

Hybrid resins (H-8) to (H-10) were prepared in the same manner as in Production Example 1 except for using Waxes (4)-(6), respectively, instead of Wax (1) shown in Table 3.

Comparative Production Example 1

Comparative Hybrid resin (R-1) was prepared in the same manner as in Production Example 3 except for replacing 100 wt. parts of Endcapped Production Example (A-1) with 100 wt. parts of Comparative Endcapped Production Example (B-1) formed by end-capping Comparative Polyester (1) formed of 38 mol. % of isophthalic acid and 43 mol. % of bisphenol A derivative of the formula (2) (R=propylene, x+y=2.2) with 19 mol. % of benzoic acid as the end-capper for the hydroxyl group, and replacing the vinyl monomer mixture for providing the vinyl polymer unit with a mixture including 70 wt. parts of styrene, 21 wt. parts of butyl acrylate, 1 wt. part of monobutyl maleate, 2 wt. parts of di-t-butyl peroxide (polymerization initiator) and 14 wt. parts of Comparative Wax 1 shown in Table 3. Comparative Hybrid resin (R-1) exhibited Mp=12,000, Tg=56° C., $V_A$=6 mgKOH/g and $THF_{ins}$,=3%.

Comparative Production Example 2

Comparative Hybrid resin (R-2) was prepared in the same manner as in Comparative Production Example 1 except for replacing 100 wt. parts of Comparative Endcapped Polyester (B-1) with 100 wt. parts of Comparative Endcapped Polyester (B-2) formed by end-capping Comparative Polyester (2) formed of 37 mol. % of isophthalic acid, 4 mol. % of fumaric acid, 8 mol. % of bisphenol A derivative of formula (2) (R=ethylene, x+y=2.4), 39 mol. % of bisphenol A derivative of the formula (2) (R=propylene, x+y=2.2) and 6 mol % of trimellitic anhydride with 16 mol. % of benzoic acid as the end-capper for the hydroxyl group. Comparative Hybrid resin (R-2) exhibited Mp=14,000, Tg=60° C., $V_A$=40 mgKOH/g and $THF_{ins}$.=61%.

Comparative Production Example 3

Comparative Hybrid resin (R-3) was prepared by blending 20 wt. parts of Comparative Polyester (B-3) formed of 34 mol. % of terephthalic acid, 6 mol. % of trimellitic acid, 20 mol. % of dodecenyl-succinic acid, 17 mol. % of bisphenol A derivative of the formula (2) (R=ethylene, x+y=2.4) and 34 mol. % of bisphenol A derivative of the formula (2) (R=propylene, x+y=2.2) with 80 wt. parts of Hybrid resin (H-1) prepared in Production Example 1. Comparative Hybrid resin (R-3) exhibited Mp=10,000, Tg=58° C., $V_A$=35 mgKOH/g, and $THF_{ins}$=59%.

Comparative Production Examples 4 and 5

Comparative Hybrid resins (R-4) and (R-5) were prepared in the same manner as in Comparative Production Example 1 except for using Comparative Waxes (2) and (3), respectively, instead of Comparative Wax (1) shown in Table 3.

Example 1

| | |
|---|---|
| Hybrid resin (H-1) prepared in Production Example 1 | 107 wt. parts |
| Magnetic material (D1 = 0.22 μm, He = 9.6 kA/m, $\sigma_s$ = 83 $Am^2/kg$, $\sigma_r$ = 15 $Am^2/kg$) | 90 wt. parts |
| Charge control agent (an organic iron compound formed of 2 mols of a monoago compound of the before-mentioned formula (4) and 1 mol. of iron) | 2 wt. parts |

The above ingredients were preliminarily blended by means of a HENSCHEL mixer and then melt-kneaded by a twin-screw extruder heated at 120° C. After being cooled, the kneaded product was coarsely crushed by a cutter mill to obtain Powdery feed (1).

Powdery feed (1) was then subjected to pulverization and classification in an apparatus system having an organization as shown in FIG. 6. A mechanical pulverizer 301 ("TURBOMILL T-250", made by Turbo Kogyo K. K.) having an organization as shown in FIG. 7 and including a rotor 314 and a stator 30 (shown in FIGS. 8 and 9) with a gap of 1.5 mm therebetween was operated at a peripheral speed of the rotor 314 of 115 mm/sec.

In this Example, the powdery feed was supplied for pulverization at a rate of 40 kg/h to the mechanical pulverizer 301 via a table-type first metering feeder 315. The pulverized feed from the mechanical pulverizer 301 was accompanied with suction air to be collected by a cyclone 229 and introduced to a second metering feeder 62. The inlet temperature and the outlet temperature of the mechanical pulverizer 301 were −10° C. and 39° C., respectively, giving a temperature difference ΔT therebetween of 49° C. The resultant Pulverizate (A) from the mechanical pulverizer 301 exhibited D4=7.2 μm and a sharp particle size distribution as represented by 29% by number of particles of at most 4.0 μm and 2.7% by volume of particles of at least 10.1 μm.

The pulverizate (A) from the mechanical pulverizer 301 was then supplied at a rate of 44 kg/h via the second metering feeder 62, a vibration feeder 63 and a feed supply nozzle 76 to a multi-division pneumatic classifier 61 having a structure shown in FIG. 10, where the pulverized feed was classified into three fractions of a coarse powder, a medium powder and a fine powder. For the classification, the pulverized feed was introduced into the classifier 61 by utilizing a gas stream through a feed supply nozzle 76 caused by evacuation through at least one of discharge ports 71, 72 and 73, and also a compressed air ejected out of a high-pressure air supply nozzle 96. The thus-introduced pulverized feed was classified into coarse powder G, medium powder M-1 and fine powder. The coarse powder G was collected by a cyclone 266 and recycled to the mechanical pulverizer 301 at a rate of 2.0 kg/h for re-pulverization.

Medium powder M-1 exhibited D4=7.0 μm, and 100 wt. parts thereof was blended with 1.0 wt. part of hydrophobic silica fine powder (BET specific surface area ($S_{BET}$)=200 $m^2/g$) to obtain Toner (1) of the present invention.

Toner (1) thus-obtained included a THF-soluble content showing a molecular weight distribution including a peak molecular weight (Mp) of 6400, a content of components having molecular weights of at least $10^5$ (% (≧$10^5$) of 3 wt. % and a ratio (Mw/Mn) of 45, and also exhibited an acid value ($V_A$) of 13 mgKOH/g.

Representative formulation and properties of Toner (1) are inclusively shown in Table 4 appearing hereinafter together with those obtained in other Examples and Comparative Examples described hereinafter.

Toner (1) thus-obtained was evaluated with respect to the following items.

<Image-Forming Performances>

(1) A continuous image formation on 20,000 sheets of A4-size paper in a normal temperature/normal humidity environment (23° C./60% RH) by using each of a digital copying machine having a process speed of 210 mm/sec and including a film fixing device as shown in FIG. 5 ("GP-405", made by Canon K. K.) and an analog copying machine having a process speed of 513 mm/sec and a hot-roller fixing system ("NP-6085", made by Canon K. K.).

(2) A continuous image formation on 20,000 sheets of A4-size paper was also performed in a high temperature/high humidity environment (32.5° C./80 % RH) by using the analog copying machine having a process speed of 513 mm/sec ("NP-6085").

In each test, the reflection image density (I.D.) of a reproduced 5 mm-dia. circular solid black image was measured by using a MACBETH densitometer (made by Macbeth Co.) equipped with an SPI-film at an initial stage and a final stage of the continuous image formation.

The analog copying machine after the continuous image formation in the high temperature/high humidity environment was further left standing in that environment for 2 days and then operated again for measurement on the image density on a first sheet after the standing. A density decrease (ID) after the standing was determined by subtracting the measured image density (ID) from the image density (ID) measured at the final stage of the continuous image formation.

<Fixing Performances>

Separately, the fixing device of an analog copying machine ("NP-608") identical to the one used in the above image-forming performance evaluation was released out of the copying machine and was equipped with an external driver, a fixing temperature controller and a roller fixing pressure controller to provide a fixing performance tester. The fixing performance tester was operated at a roller peripheral speed of 170 mm/sec and a total pressing force of 313.6 N (32 kg·f) for fixing a yet-unfixed solid image giving an image density of 1.3 on an A4-size paper at two roller surface temperatures of 145° C. and 220° C. for evaluation of the low-temperature fixability and high-temperature offset property, respectively.

(Low-Temperature Fixability)

The image fixed at the fixing temperature of 145° C. was rubbed with a lens cleaning paper under a load of 4900 N/m$^2$ (50 g/cm$^2$), and the low-temperature fixability was evaluated based on the % of image density lowering (ΔID10) after the rubbing according to the following standard.

A: ΔID<5%

B: 5%≦ΔID<10%

C: 10%≦ΔID<15%

D: 10%≦ΔID<20%

E: 20%≦ΔID (Anti-High-Temperature Offset Property)

Anti-high-temperature offset property was evaluated based on the fixing test at a fixing temperature of 220° C. according to the following standard.

A: No offset observed at all.

B: Slight offset observed but at a practically acceptable level.

C: Offset observed at a level easily recognizable with eyes.

D: Conspicuous offset observed.

E: Severe offset at a level of causing paper winding.

<Wax Dispersibility>

A toner sample was observed through an optical microscope at a low magnification of ca. 100 equipped with a polarizer, and a number of bright spots representing wax particles isolated from toner particles were counted per ca. 500 toner particles. The evaluation was performed according to the following standard.

A: No bright spots observed.

B: 1-10 bright spots (a level of practically no problem).

C: 11-20 bright spots (a level of providing a fog image density).

D: 21-30 bright spots (a level of causing the sticking of wax onto the photosensitive drum).

E: More than 30 bright spots (a level of causing toner sticking in addition to the wax sticking onto the photosensitive drum).

<Anti-Blocking Property>

A toner sample was left standing for 72 hours in an environment of 50° C., and the powdery state of the toner sample was evaluated according to the following standard.

A: No change in flowability observed.

B: Slight lowering in flowability observed.

C: Some agglomerate is observed but can be easily disintegrated with fingers (a practically acceptable level).

D: Toner agglomerated is observed and liable to leave a non-disintegrated core portion after the disintegration.

E: Toner sample is blocked as a cake.

The results of the above evaluation are inclusively shown in Table 5 appearing hereinafter together with those of the toners obtained in the following Examples and Comparative Examples.

Example 2

Toner (2) was prepared and evaluated in the same manner as in Example 1 except for using 100 wt. parts of Hybrid resin (H-2) and 7 parts of Wax (1) instead of 107 wt. parts of Hybrid resin (H-1).

Examples 3 to 10

Toner (3) to (10) were prepared and evaluated and evaluated in the same manner as in Example 1 except for using Hybrid resins (H-3) to (H-10), respectively, instead of Hybrid resin (H-1).

Comparative Example 1

| | |
|---|---|
| Comparative Hybrid resin (R-1) | 107 wt. parts |
| Magnetic material (Same as in Example 1) | 90 wt. parts |
| Charge control agent (Same as in Example 1) | 2 wt. parts |

The above ingredients were melt-kneaded by a twin-screw extruder heated at 130° C. After being cooled, the kneaded product was coarsely crushed by a cutter mill and then finely pulverized by a jet mill, followed by pneumatic classification to obtain Comparative Toner (1) having D4=7.3.

Comparative Toner (1) thus-obtained was evaluated in the same manner as in Example 1.

Comparative Examples 2 to 5

Comparative Toners (2) to (5) were prepared and evaluated in the same manner as in Comparative Example 1 except for using Comparative Hybrid resins (R-2) to (R-5), respectively, instead of Comparative Hybrid resin (R-1).

The results of the evaluation in the above Examples and Comparative Examples are inclusively shown in Table 5.

TABLE 3

Waxes used in Examples

| Wax | Wax species | Mp | Mw/Mn | Tabs. 60~90° C. | Tabs. 90-150° C. |
|---|---|---|---|---|---|
| (1) | styrene-modified hydrocarbon | 1000 | 1 | — | 105° C. |
| (2) | Wax(1) + paraffin | 880 | 5.2 | 73.7° C. 80.1° C. | 106° C. |
| (3) | Wax(1) + styrene modified paraffin | 900 | 7.3 | 73.3° C. 80.1° C. | 105° C. |
| (4) | hydrocarbon | 1180 | 1.5 | 87° C. | — |
| (5) | polyethylene | 1600 | 1.3 | — | 94° C. |
| (6) | hydrocarbon | 2800 | 1.3 | — | 113° C. |
| Comp. (1) | polypropylene | 5900 | 24 | — | 133° C. |
| Comp. (2) | polypropylene | 300 | 1.2 | 65° C. | — |
| Comp. (3) | carnauba | | | 82° C. | — |

TABLE 4

| Toner Formulation and Properties | | | | | | | | | | |
|---|---|---|---|---|---|---|---|---|---|---|
| | | | Toner properties | | | | | | | |
| Example | Hybrid resin | Wax | Temp. (° C.) at tan δ = 1 | Tabs (° C.) | G' at tan δ = 1 ($\times 10^5$ dyn/cm$^2$) | Mw/Mn | % ($\geqq 10^5$) | Acid value (mgKOH/g) | $THF_{ins*}$ (%) | Vinyl polymer in THF-soluble (wt %) |
| 1 | H-1 | (1) | 109 | 102 | 2 | 45 | 3 | 13 | 40 | 65 |
| 2 | H-2 | (1)* | 93 | 103 | 3 | 150 | 8 | 12 | 38 | 63 |
| 3 | H-3 | (1) | 143 | 102 | 1.4 | 42 | 2.4 | 8 | 18 | 31 |
| 4 | H-4 | (1) | 96 | 102 | 5 | 36 | 1.6 | 17 | 44 | 72 |
| 5 | H-5 | (1) | 87 | 102 | 30 | 28 | 1.3 | 22 | 53 | 76 |
| 6 | H-6 | (1) | 128 | 102 | 0.3 | 305 | 9 | 11 | 15 | 41 |
| 7 | H-7 | (1) | 122 | 102 | 0.4 | 96 | 6.6 | 12 | 19 | 35 |
| 8 | H-8 | (1) | 102 | 86 | 1.3 | 111 | 6 | 11 | 28 | 63 |
| 9 | H-9 | (1) | 105 | 94 | 1.5 | 115 | 5 | 10 | 28 | 64 |
| 10 | H-10 | (6) | 113 | 115 | 3.6 | 110 | 4 | 13 | 31 | 63 |
| Comp. 1 | R-1 | Comp. (1) | 165 | 134 | 0.07 | 510 | 18 | 4 | 0.6 | 20 |
| Comp. 2 | R-2 | Comp. (1) | 76 | 133 | 100 | 10 | 0.2 | 29 | 65 | 90 |
| Comp. 3 | R-3 | Comp. (1) | 156 | 133 | 80 | 11 | 21 | 23 | 62 | 33 |
| Comp. 4 | R-4 | Comp. (2) | 71 | 66 | 0.3 | 550 | 17 | 3 | 0.8 | 21 |
| Comp. 5 | R-5 | Comp. (3) | 94 | 82 | 0.8 | 505 | 11 | 4 | 0.6 | 19 |

*In Example 2, Wax (1) was added at the time of toner preparation.

TABLE 5

| Toner Performances | | | | | | | | | | | |
|---|---|---|---|---|---|---|---|---|---|---|---|
| | Image forming performances, Image density | | | | | | | | | | |
| | NT/NH(23° C./60% RH) | | | | HT/HH(32.5°/80% RH) | | | | | | |
| | by GP-405 | | by NP-6085 | | by NP-6085 | | | Fixability | | | |
| Example | initial | after 2000 sheets | initial | after 20000 sheets | initial | after 20000 sheets | Δ ID after standing | at 145° C. | offset at 220° C. | Wax dispersion | Anti-block |
| 1 | 1.44 | 1.43 | 1.45 | 1.44 | 1.44 | 1.44 | 0.05 | A | A | A | A |
| 2 | 1.45 | 1.45 | 1.46 | 1.45 | 1.46 | 1.44 | 0.04 | B | A | C | B |
| 3 | 1.43 | 1.42 | 1.43 | 1.43 | 1.4 | 1.39 | 0.07 | B | B | A | B |
| 4 | 1.45 | 1.43 | 1.45 | 1.44 | 1.44 | 1.43 | 0.05 | A | B | A | A |
| 5 | 1.44 | 1.42 | 1.45 | 1.43 | 1.45 | 1.44 | 0.04 | A | B | A | A |
| 6 | 1.43 | 1.42 | 1.43 | 1.43 | 1.41 | 1.40 | 0.06 | C | C | A | C |
| 7 | 1.42 | 1.41 | 1.43 | 1.42 | 1.41 | 1.40 | 0.07 | B | B | A | B |
| 8 | 1.43 | 1.41 | 1.43 | 1.42 | 1.40 | 1.39 | 0.04 | A | B | B | C |
| 9 | 1.40 | 1.38 | 1.41 | 1.40 | 1.39 | 1.38 | 0.06 | A | B | B | B |
| 10 | 1.40 | 1.39 | 1.42 | 1.41 | 1.40 | 1.37 | 0.08 | B | A | B | A |
| Comp.1 | 0.68 | 0.60 | 0.77 | 0.65 | 0.56 | 0.40 | 0.19 | D | E | E | E |
| Comp.2 | 0.75 | 0.63 | 0.81 | 0.65 | 0.65 | 0.41 | 0.28 | E | C | D | D |
| Comp.3 | 0.70 | 0.61 | 0.74 | 0.62 | 0.61 | 0.43 | 0.25 | E | C | E | E |
| Comp.4 | 0.69 | 0.59 | 0.78 | 0.63 | 0.55 | 0.39 | 0.20 | D | E | E | E |
| Comp.5 | 0.72 | 0.65 | 0.76 | 0.56 | 0.51 | 0.41 | 0.26 | D | E | D | D |

What is claimed is:

1. A toner comprising: at least a binder resin, a colorant, a charge control agent and a wax, wherein (a) the binder resin comprises a hybrid resin component having a polyester unit and a vinyl polymer unit;

(b) the toner exhibits a loss tangent (tan δ) of 1.0 at a temperature in a range of from 80° C. to 160° C.;

(c) the toner provides a DSC curve showing a heat-absorption peak in a temperature range of from 85° C. to 130° C. on temperature increase as measured according to differential scanning calorimetry (DSC); and (d) the polyester unit has an end-capped hydroxyl group produced by reaction with benzoic acid.

* * * * *